US007278360B2

(12) United States Patent
Griepentrog

(10) Patent No.: US 7,278,360 B2
(45) Date of Patent: Oct. 9, 2007

(54) VARIABLE CONFIGURATION DESK SYSTEM WITH POWER AND COMMUNICATION CAPABILITY

(75) Inventor: Dennis G. Griepentrog, DePere, WI (US)

(73) Assignee: Krueger International, Inc., Green Bay, WI (US)

( * ) Notice: Subject to any disclaimer, the term of this patent is extended or adjusted under 35 U.S.C. 154(b) by 338 days.

(21) Appl. No.: 10/349,348

(22) Filed: Jan. 22, 2003

(65) Prior Publication Data

US 2003/0136313 A1 Jul. 24, 2003

Related U.S. Application Data

(60) Provisional application No. 60/351,220, filed on Jan. 23, 2002.

(51) Int. Cl.
*A47B 37/00* (2006.01)

(52) U.S. Cl. ..... 108/50.02; 312/223.3

(58) Field of Classification Search ..... 108/50.01, 108/50.02; 312/194, 195, 196, 223.3, 223.6; 52/36.1

See application file for complete search history.

(56) References Cited

U.S. PATENT DOCUMENTS 838,567 A * 12/1906 Nolen ..... 312/238
1,917,917 A 7/1933 Bales
1,920,028 A 7/1933 Wilkin
2,349,144 A 5/1944 Corso
2,789,702 A 4/1957 Schofield
2,912,073 A 11/1959 Sherron
3,040,905 A 6/1962 Gingher et al.
3,114,584 A 12/1963 Wilmer
3,635,174 A 1/1972 Ball et al.
3,862,785 A 1/1975 Scheerhorn et al.
4,094,256 A 6/1978 Holper et al.
4,094,561 A * 6/1978 Wolff et al. ..... 312/223.6
4,163,867 A 8/1979 Breidenbach
4,284,840 A 8/1981 Baker
4,343,245 A 8/1982 Edwards
4,408,543 A 10/1983 Griffin (Continued)

OTHER PUBLICATIONS

"Volition—Freestanding Desk System", Brochure OE-00453/KN/S44/IN/IN0802, OEI, Green Bay, WI 54302, 2002.

(Continued)

*Primary Examiner*—Janet M. Wilkens
(74) *Attorney, Agent, or Firm*—Boyle Fredrickson, SC

(57) ABSTRACT

A desk system with power and/or communication capability includes a series of interconnected desk sections. Each desk section includes a pair of leg that support a worksurface, and one or more stanchions extend upwardly from the worksurface. A primary power distribution system is located below the worksurface. The primary power distribution system includes receptacles mounted to a beam that extends between the pair of legs. Openings are formed in the legs for enabling the primary power distribution system to pass from one desk section to another. Each stanchion defines an open interior and is mounted above an opening formed in the worksurface. Each stanchion includes a mounting plate, and one or more power and/or communication supply blocks are adapted for securement to the mounting plate. Flexible cords or cables extend from each mounting block through the opening in the worksurface, and are plugged into the receptacles or the primary power distribution system located below the worksurface.

12 Claims, 21 Drawing Sheets

U.S. PATENT DOCUMENTS 4,422,385 A 12/1983 Rutsche et al.
4,479,030 A 10/1984 Votteler et al.
4,555,082 A 11/1985 Sack et al.
4,603,229 A 7/1986 Menchetti
4,630,417 A 12/1986 Collier
4,646,211 A 2/1987 Gallant et al.
4,734,826 A 3/1988 Wilson et al.
4,755,010 A 7/1988 Wilson et al.
4,762,072 A 8/1988 Boundy et al.
4,792,881 A 12/1988 Wilson et al.
4,974,915 A 12/1990 Bussard
5,065,832 A * 11/1991 Mark ..... 108/60
5,083,512 A * 1/1992 Newhouse et al. ..... 108/50.02
5,094,174 A * 3/1992 Grund et al. ..... 108/153.1
5,160,188 A 11/1992 Rorke et al.
5,183,319 A * 2/1993 Pearson et al. ..... 312/196
5,220,871 A * 6/1993 Grund et al. ..... 108/59
5,226,705 A 7/1993 Rorke et al.
5,318,259 A 6/1994 Fussler
5,378,058 A 1/1995 Tessmer
5,394,658 A * 3/1995 Schreiner et al. ..... 52/36.1
5,429,431 A * 7/1995 Olson et al. ..... 312/223.6
5,451,101 A 9/1995 Ellison et al.
5,461,974 A 10/1995 Reneau
D376,705 S 12/1996 Stoddard et al.
5,606,920 A * 3/1997 Meyer et al. ..... 108/50.02
5,609,112 A 3/1997 Meyer et al.
5,660,120 A * 8/1997 Sims ..... 108/60
5,673,632 A 10/1997 Sykes
5,833,332 A 11/1998 Marshall et al.
5,853,236 A 12/1998 Rogers et al.
5,886,295 A 3/1999 Carino et al.
5,901,513 A * 5/1999 Mollenkopf et al. ..... 52/220.7
D410,351 S 6/1999 Magnusson et al.
5,921,795 A 7/1999 Weener et al.
5,934,203 A * 8/1999 Glass ..... 108/156
5,980,004 A 11/1999 Shoenfeld
D427,823 S 7/2000 Schacht et al.
6,116,597 A 9/2000 Rowe et al.
6,122,865 A 9/2000 Branc et al.
6,131,347 A 10/2000 Hornberger et al.
6,196,648 B1 3/2001 Henriott
6,352,323 B1 * 3/2002 Rives ..... 312/324
6,732,660 B2 * 5/2004 Dame et al. ..... 108/50.01
2005/0189851 A1 * 9/2005 Martin et al. ..... 312/196

OTHER PUBLICATIONS

"Morrison Network Assembly Instructions", Part No. 5172800, Knoll International, 655 Madison Avenue, New York, New York 10021, undated.

"Morrison", BM-95 The Knoll Group Aug. 1995, The Knoll Group, 1235 Water Street, East Greenville, PA 18041.

* cited by examiner

VARIABLE CONFIGURATION DESK SYSTEM WITH POWER AND COMMUNICATION CAPABILITY

CROSS-REFERENCE TO RELATED APPLICATION

This application claims the benefit of U.S. Provisional Application Ser. No. 60/351,220, filed Jan. 23, 2002.

BACKGROUND AND SUMMARY OF THE INVENTION

This invention relates to a desk system, and more particularly to a variable configuration desk system for providing power and communication capability accessible from a location above the worksurface of the desk system.

Various powered table or desk systems are known, which provide outlets or receptacles to supply power or communication capability to various items supported by the worksurface of the desk system, such as a computer, telephone, lamp, etc.

It is an object of the present invention to provide a variable configuration desk system having an improved arrangement for supplying power or data connections that can be quickly and easily accessed by a user. It is a further object of the invention to provide such a desk system which enables various types of connections to be made according to user requirements. It is a further object of the invention to provide such a desk system in which the components of the power and communication distribution system are incorporated into the structural elements of the desk system. Yet another object of the invention is to provide such a desk system having a construction that facilitates assembly and installation of the structural components of the desk system as well as the power and communication distribution system associated with the desk system. A still further object of the invention is to provide such a desk system in which the configuration of the components of the desk system can vary according to user requirements.

In accordance with the present invention, a desk system includes a pair of spaced apart leg members and a worksurface supported by the pair of leg members, together with a power stanchion located above at least one of the leg members. Each leg member includes an open interior. The power stanchion defines a receptacle mounting arrangement above the worksurface, and the worksurface includes an opening that establishes communication between the receptacle mounting arrangement and the open interior of the leg member. A power supply arrangement includes a primary power supply located below the worksurface and a stanchion power supply that extends from the primary power supply through the opening in the worksurface. The stanchion power supply includes a stanchion power supply receptacle engaged with the receptacle mounting arrangement of the power stanchion. The desk system may include a pair of power stanchions that extend upwardly from the worksurface, and an overhead storage member is mounted to and supported between the pair of power stanchions.

The receptacle mounting arrangement of each power stanchion is preferably in the form of an internal mounting plate incorporated in the power stanchion, and one or more power or communication outlets or receptacles are mounted to the internal mounting plate. Each stanchion also includes a cover that is movable between an open position and a closed position for selectively providing access to the power and communication outlets or receptacles. The internal mounting plate and the cover are configured to define an outer space from which the power or communication outlets or receptacles are accessible when the cover is in the open position. The internal mounting plate is operable to define an inner space within which the power or communication outlets or receptacles are disposed. A flexible cord or cable extends from each of the power or communication outlets or receptacles, and passes through the worksurface opening for engagement with the primary power supply located below the worksurface. The worksurface opening is positioned and configured so as to enable cords or cables to pass through the worksurface from the inner space, and also to allow cords or cables from items supported by the worksurface to pass through the worksurface for engagement with the primary power supply. In this manner, items supported by the worksurface can be connected either above the worksurface or below the worksurface. The cover preferably includes a lower edge that is spaced from an upwardly facing surface defined by the worksurface. A resilient seal member is mounted to the lower edge of the cover, for sealing about cords or cables that extend into the stanchion from items supported by the worksurface.

Also in accordance with the present invention, a desk system includes a series of adjacent desk sections, each of which includes a worksurface and a pair of spaced apart leg members that support the worksurface above a supporting surface such as a floor. Each leg member defines an open interior. A power distribution system supplies power to the desk sections. The power distribution system includes at least one opening in each leg member, and a power supply arrangement that extends through the openings in the leg members for supplying power between adjacent desk sections. Each leg member is preferably defined by a pair of generally perpendicular outer walls, and each outer wall includes at least one opening. In one form, each outer wall includes a pair of openings, one of which is located toward the upper end of the outer wall and the other of which is located toward the lower end of the outer wall. When a pair of desk sections are placed adjacent each other, the openings in the facing outer walls of adjacent leg members are in alignment with each other to allow the components of the power distribution system to pass therethrough, and the openings in the other walls of the adjacent leg members are exposed. A leg opening cover is configured for engagement with the leg member over each exposed opening. The features of the present invention can be utilized independent of each other, or can be used in combination to provide a particularly preferred desk system construction.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Background and Summary

The drawings illustrate a representative embodiment of a desk system 50 constructed according to the invention. While the drawings illustrate certain configurations of desk system 50, it is understood that numerous other configurations are possible using other worksurface shapes and/or sizes than are shown, according to user requirements or specifications. The invention resides in the worksurface support and power distribution arrangement, i.e. the leg structure used to support the various worksurfaces incorporated in desk system and the components above the worksurfaces that may be used to support overhead storage cabinets incorporated in desk system 50, in combination with the power and communication distribution system associated with desk system 50.

Figure 1:
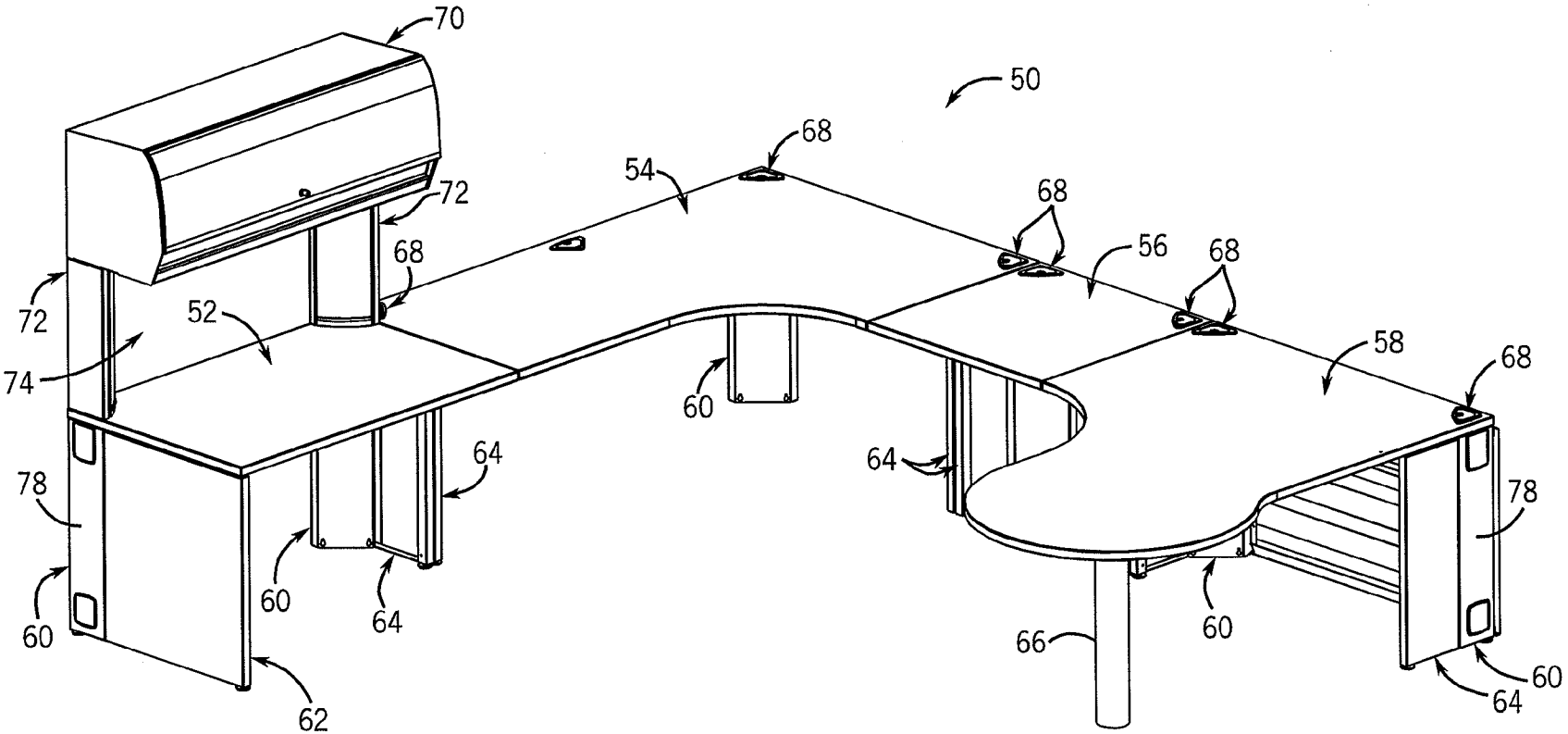
FIG. 1 is an isometric view of a representative embodiment of a desk system constructed according to the invention, showing the forward area of the desk system.
Figure 2:
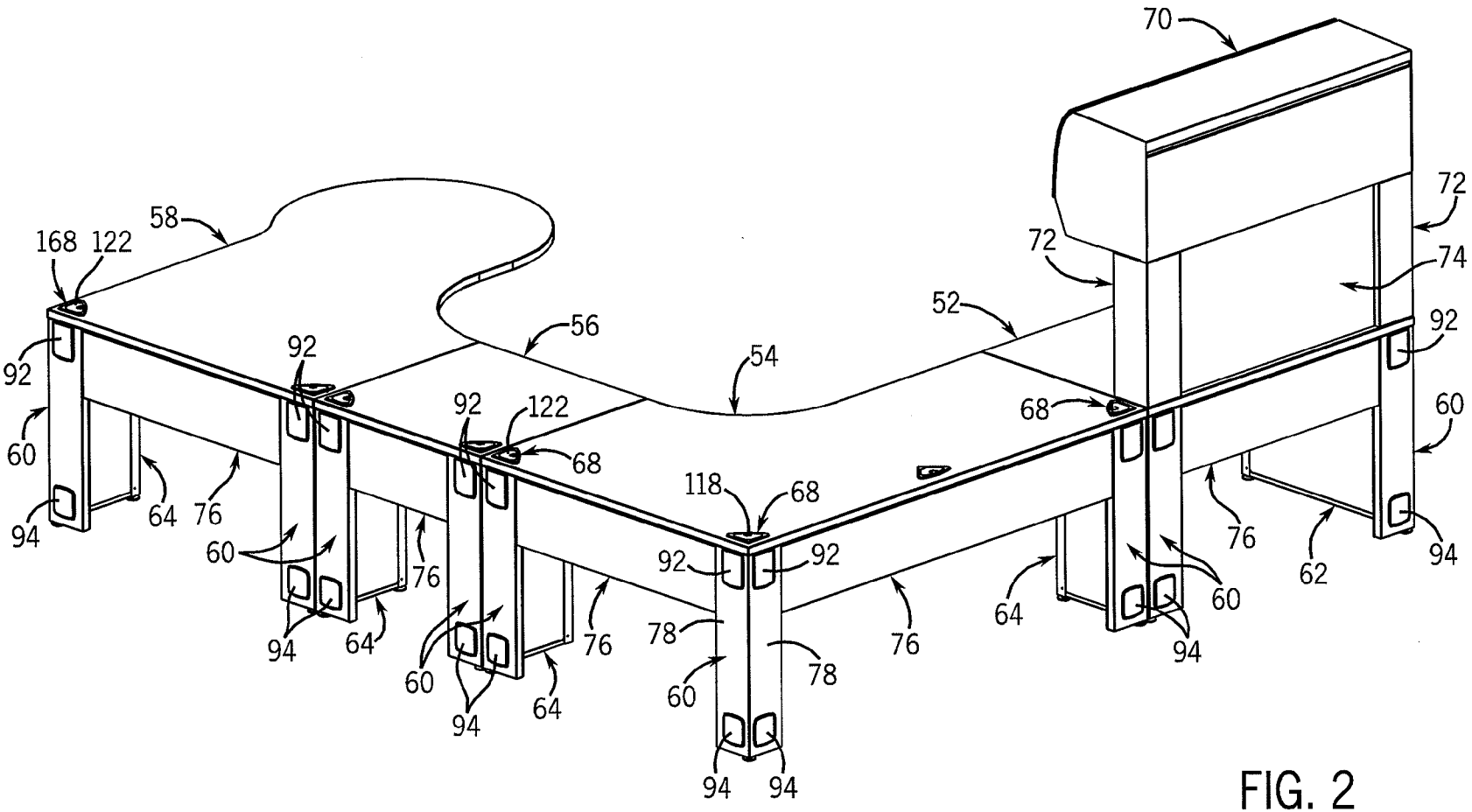
FIG. 2 is an isometric view showing the rear area of the desk system of FIG. 1.

Referring to FIGS. 1 and 2, desk system 50 generally includes a series of worksurfaces, which are representatively shown at 52, 54, 56 and 58. Each worksurface is supported by a pair of spaced apart legs 60, located one at each rear corner of the worksurface. In addition, each worksurface is further supported by an end panel that extends forwardly from the leg 60 at each end of each worksurface. The end panel may be in the form of a full end panel 62 or a partial end panel 64. For extended worksurfaces such as 58, an additional leg 66 may be provided for supporting the forward area of the worksurface.

In a manner to be explained, desk system 50 is provided with both power and communication capability, for providing power and communication wiring to components supported by or accessible from worksurfaces 52-58. A power/communication grommet or access member 68 is located at each corner of each of worksurfaces 54-58 at a location above one of legs 60, for enabling power and communication wiring to pass from the top of the worksurface to an area below the worksurface. In this manner, power and communication wiring from equipment supported by or accessible from the worksurface can be passed below the worksurface for engagement with a power or communication receptacle supported by the supporting structure of each worksurface, or such wiring supported by the worksurface supporting structure can be passed outwardly to the top of the worksurface for connection to a device supported by the worksurface.

In addition, a pair of stanchions 72 may be mounted to one or more of the worksurfaces for providing power and/or communication capability to the area above the worksurface in a manner to be explained. Stanchions 72 may be employed to mount an overhead storage unit, such as 70, above the worksurface. Each stanchion 72 is located at one of the rear corners of the worksurface above one of legs 60. Each stanchion 72 is constructed to define an interior or passage which communicates with an internal cavity or passage defined by the underlying leg 60 through an opening formed in the worksurface, such as 52. As will be explained, each stanchion 72 has one or more power and/or communication receptacles which provide power and communication connections at a location above the worksurface. In addition, stanchions 72 are adapted to house power supply wiring for a task light mounted to the underside of overhead storage cabinet 70, or for any other electrical component associated with overhead storage cabinet 70. A privacy screen 74 may be connected between stanchions 72, in a manner to be explained.

Referring to FIGS. 2-5, a beam 76 extends between each pair of legs 60 that support one of the worksurfaces. In this manner, each worksurface, in combination with its associated legs 60, end panels 62 or 64, and beam 76 makes up a desk section, and the adjacent desk sections are connected together to form desk assembly 50.

Each leg 60 is generally triangular in cross-section, and defines an open interior. Representatively, each leg 60 may have a pair of perpendicularly oriented outer walls 78, which are bent inwardly at their outer ends toward each other so as to form spaced apart outwardly facing vertical flanges 80. Each leg 60 further includes an upper horizontal mounting flange 82 and a lower horizontal flange 84. Outer walls 78, vertical flanges 80 and horizontal flanges 82, 84 may be integrally formed of a relatively heavy sheet metal material, although other constructions may be employed. An upper opening 86 and a lower opening 88 are formed in each outer wall 78. A leg opening frame 90 is engaged within each of upper and lower openings 86, 88. One of two leg opening covers 92, 94 are adapted for engagement within each frame 90.

Each leg 60 includes diagonally oriented reinforcement plate 96 located within the leg interior, which defines outer ends that are engaged with and connected to the inner surfaces of leg outer walls 78. The ends of reinforcement plate 96 may be secured to flanges 80 of outer walls 78 in any satisfactory manner, such as by spot welding. Reinforcement plate 96 functions to impart rigidity to the structure of leg 60 and to maintain the angular relationship between leg outer walls 78.

At the lower end of leg 60, a triangular mounting plate 98 is connected to each lower mounting flange 84, and a glide 100 is engageable with a rivet nut 102 secured to mounting plate 98 for adjustably supporting leg 60 on a supporting surface such as a floor. At the upper end of leg 60, a series of rivet nuts 104 are secured to upper horizontal mounting flange 82.

The vertical flanges 80 of leg 60 include a series of openings within which mounting screws such as 106 are adapted to be engaged. A leg cover plate 108 (FIG. 5) has a series of tear drop openings 110 which are adapted to receive the heads of mounting screws 106, to enable cover plate 108 to be releasably engaged with vertical flanges 80 of leg 60. In this manner, cover plate 108 functions to span across the space defined between vertical flanges 80, to conceal the lower portion of the interior of leg 60.

In the vicinity of each leg 60, each worksurface section, such as 52, is provided with an opening 112 (FIGS. 3, 5) which is located above the open interior of the underlying leg 60 so as to be in communication therewith. In this manner, worksurface opening 112 establishes communication between the open interior of each leg 60 and the upper support surface defined by the worksurface. The worksurface, such as 52, is secured to each leg 60 by means of a series of screws that extend through the worksurface and into engagement with the rivet nuts 104 secured to upper horizontal mounting flange 82 of each leg 60. Grommet 68 is adapted for engagement within the opening, such as 112, formed in the worksurface. Grommet 68 defines an opening 118 that provides access to the worksurface opening, such as 112, and thereby the interior of leg 60, from the upper surface of the worksurface. A grommet cover 122 is engageable with grommet 68 over grommet opening 118, and is formed with a notch 124. Grommet cover 122 functions to enclose the grommet opening 118, and notch 124 enables power or communication wires to pass through grommet cover 122.

End panels 62, 64 are similarly constructed. Each end panel 62, 64 includes a primary end panel wall 126, an outer post section 128, an inner mounting flange 130, a top horizontal flange 134 and a bottom horizontal flange 136. In a representative embodiment as shown, these components of end panels 62, 64 may be formed of a stamped and bent sheet metal material spot welded together at the areas of overlap to form the various components and surfaces as shown, in a known manner. A rivet nut is engaged within an opening formed in bottom flange 136, and is adapted to receive a glide 100 for adjustably supporting end panel 62, 64 on a supporting surface such as a floor. Similarly, a rivet nut is engaged with top flange 134, for use in securing the outer end of end panel 62, 64 to the underside of the worksurface. A spacer 142 is engageable within an opening formed in top flange 134, and is engageable with the underside of the worksurface so as to provide a space between the worksurface and the top of end panel 62, 64. A ganging bracket 144 is adapted for engagement with the adjacent ends of the worksurfaces of adjacent desk sections, for connecting the desk sections together.

Each end panel 62, 64 is positioned to abut leg 60 and to extend forwardly therefrom. Mounting flange 130 of each end panel 62, 64 has an angle that corresponds to that of vertical flange 80 of leg 60, and is positioned so as to overlap vertical flange 80. Mounting flange 130 and the underlying leg flange 80 are formed with aligned openings, such that end panel 62, 64 is mounted to leg 60 by threaded fasteners that extend through the aligned openings.

Figure 3:
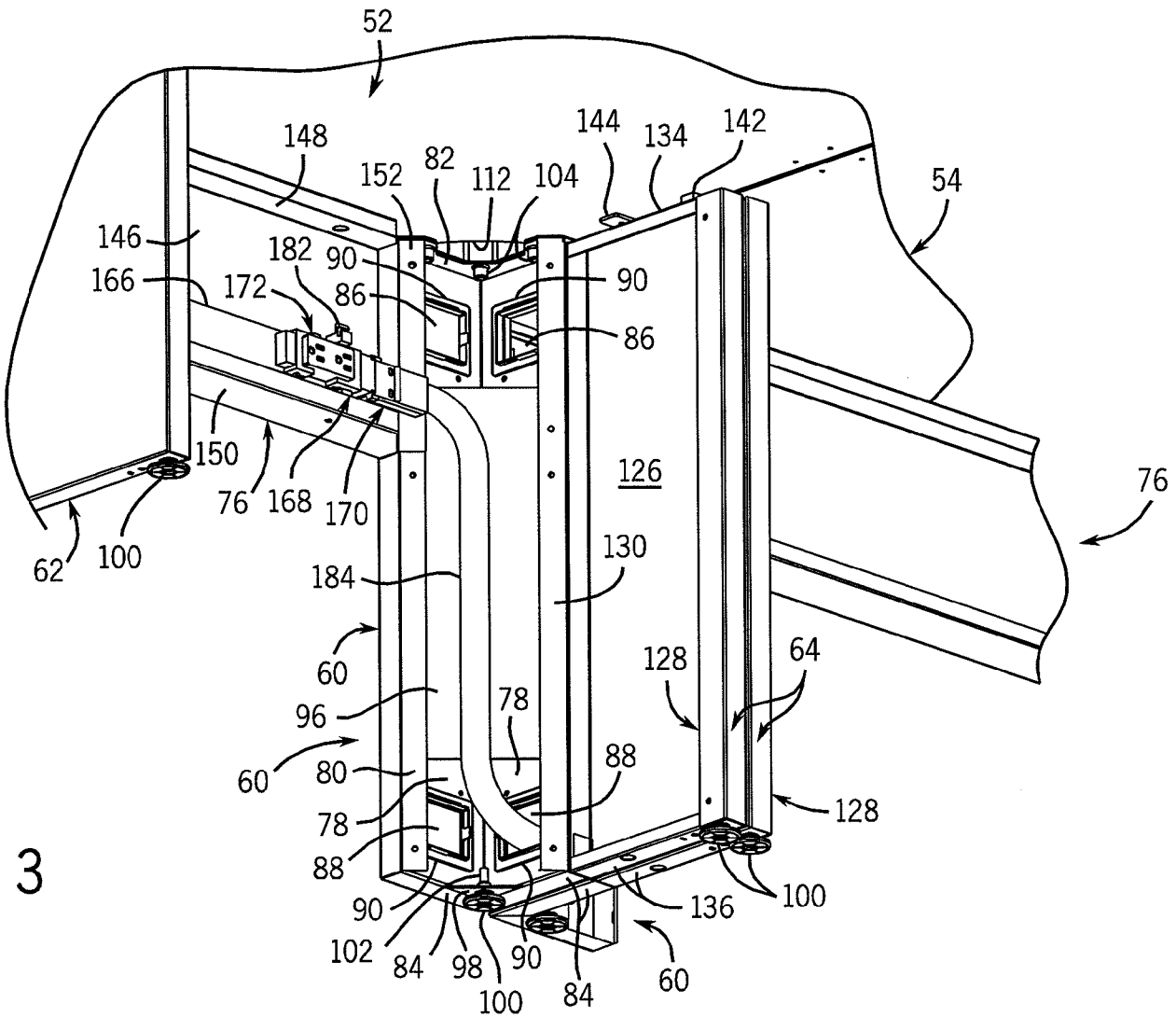
FIG. 3 is a partial isometric view illustrating one of the leg members and a primary power supply arrangement incorporated into the desk system of FIGS. 1 and 2.
Figure 4:
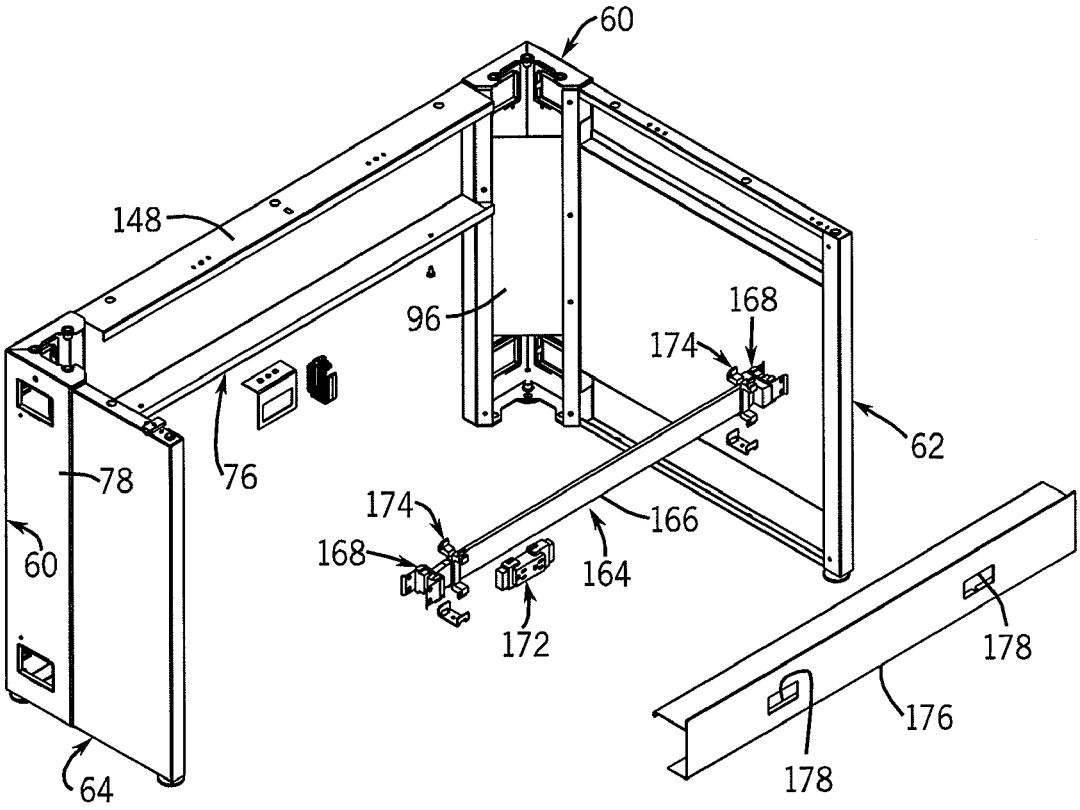
FIG. 4 is an exploded isometric view showing a rigid wireway power distribution arrangement incorporated in the desk sections in the desk system of FIG. 1.
Figure 5:
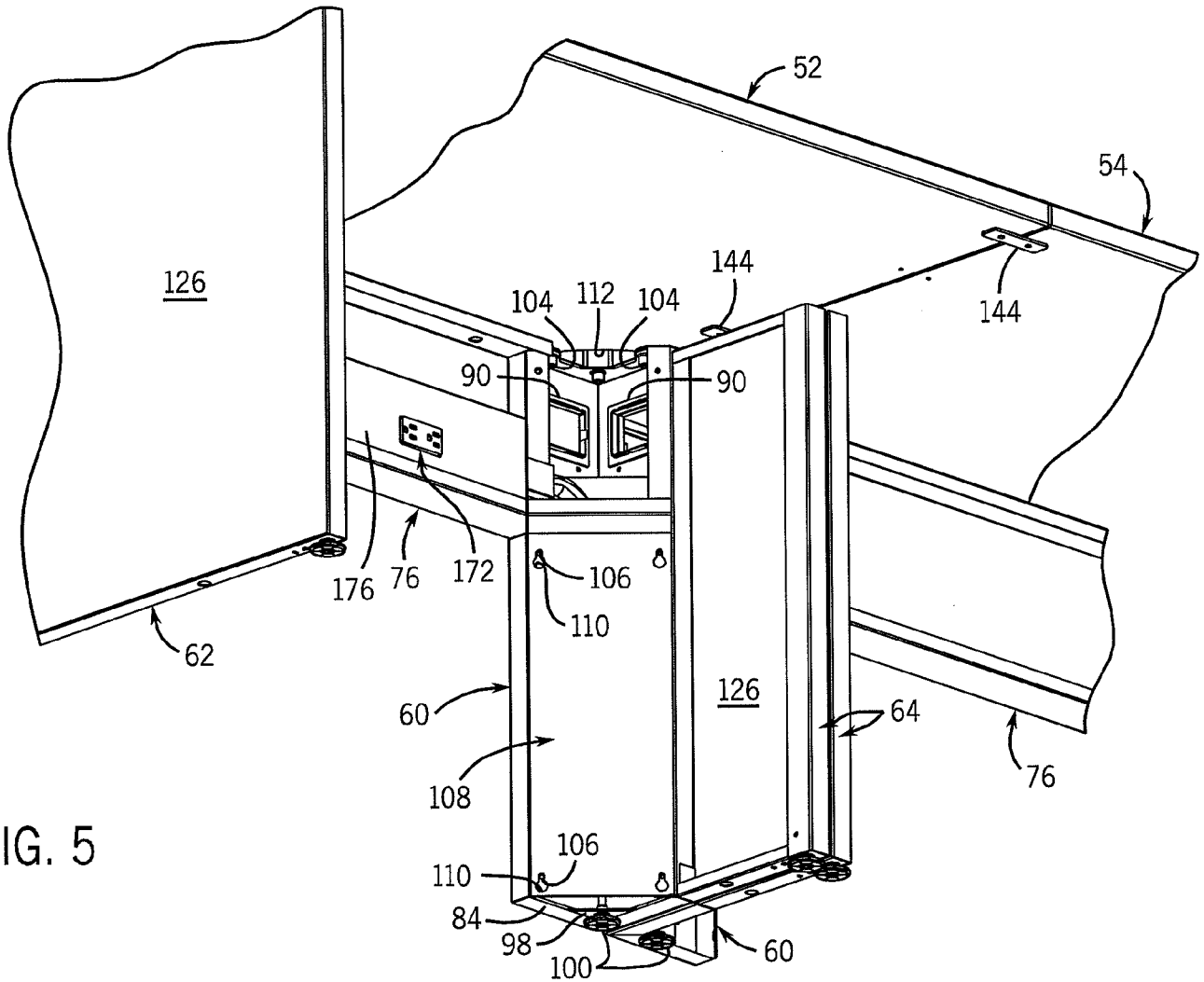
FIG. 5 is a view similar to FIG. 3, showing cover members for enclosing the components of the primary power supply system.

With continued reference to FIGS. 3-5, beam 76, which extends between the legs 60 of each desk section, includes a primary beam wall 146, a top mounting flange 148, a bottom flange 150, and a pair of angled end mounting flanges 152. The ends of beam 76 are adapted to abut leg 60, and mounting flanges 152 have an angle that corresponds to that of vertical flange 80 of leg 60. In this manner, beam 76 is assembled to each leg 60 by placing mounting flange 152 in overlapping relationship with vertical flange 80 of leg 60, and engaging fasteners through aligned openings in flanges 80, 150.

If desired, a modesty panel may be secured between legs 60 below bottom flange 150 of beam 76. The modesty panel includes a primary wall, top and bottom flanges, and angled side mounting flanges similar to flanges 152. The modesty panel is constructed to fill the space between legs 60 and below beam 76. Each mounting flange is adapted to overlap one of vertical flanges 80 of leg 60, for connection thereto by fasteners that extend through the aligned openings in the respective flanges.

A primary power distribution system provides electrical power below the worksurfaces of desk system 50, which is accessible through power/communication access members 68. With reference to FIGS. 3-5, one embodiment of the primary power distribution system incorporates a rigid wireway power distribution arrangement, which may include a conventional rigid wireway system 164 mounted to beam 76. In a known manner, rigid wireway system 164 includes a rigid conduit 166 within which a series of wires are located, and which terminate in a pair of connection blocks 168 located one at each end of rigid conduit 166. In a known manner, each connection block 168 is adapted to receive a power supply connector 170 so as to supply power to rigid wireway system 164. In addition, a power outlet block 172 is adapted for engagement with connection block 168. Power outlet block 172 has conventional power outlet receptacle structure, for providing electrical power outlets associated with rigid wireway system 164, in a known manner. A series of brackets 174 are adapted for engagement with beam 76 so as to attach rigid wireway system 164 to beam 76. In addition, a rigid wireway cover 176 is engageable with beam 76 and with outlet block 172, for concealing rigid wireway system 164. Cover 176 includes a pair of openings 178 within which outlet blocks 172 are located, for providing access to the receptacles of outlet blocks 172. Rigid wireway cover 176 further includes a pair of retainers which are movable into and out of engagement with upstanding clip members 182 associated with rigid wireway system 164, for removably mounting rigid wireway cover 176 over rigid wireway system 164.

Power supply connector 170 is located at the end of a flexible conduit 184, which extends into the interior of leg 60. Conduit 184 extends downwardly from connector 170 and passes through the lower opening 88 in leg outer wall 78 that faces the outer wall 78 of the adjacent leg 60. Conduit 184 is located in the interior of leg 60 between reinforcement plate 96 and leg cover plate 108, such that leg cover plate 108 functions to conceal conduit 184. Conduit 184 may be provided with a similar power supply connector 170 at its opposite end for engagement with a rigid wireway system associated with the adjacent desk section, such that connectors 170 and conduit 184 function to form a jumper for communicating electrical power between adjacent desk sections. Alternatively, conduit 184 may extend from a conventional electrical floor-mounted power supply, so as to provide input power to rigid wireway system 164 which is then communicated between adjacent desk sections by rigid wireways and jumper conduits and connectors, as shown. Conduit 184 extends through the aligned openings defined by leg opening frames 90 mounted within lower openings 88 in outer walls 78 of adjacent legs 60, so as to maintain the power supply toward the lower extent of beam 76 and legs 60. The upper leg openings 86 and leg opening frames 90 are employed to mount data or voice communication wiring between adjacent desk sections. Such data or voice wiring extends through worksurface opening 112 for supply to communication devices, such as telephones or computers, supported by the worksurface. Similarly, power supply wiring, such as cords and plugs, extend from such devices through worksurface opening 112 to the area below the worksurface, for connection to the receptacles defined by power supply outlet blocks 172 to provide electrical power to such equipment.

Lower leg opening covers 94 are engaged with the leg opening frames 90 associated with the exposed outwardly facing leg openings 88 at the lower ends of legs 60, and upper leg opening covers 92 are engaged with the leg opening frames 90 located within the exposed outwardly facing upper leg openings 86.

Data and voice communication wiring may be supported below the worksurface by hanger brackets engaged with beam 76, e.g. mounted to beam top flange 148 so as to be suspended therefrom.

Figure 6:
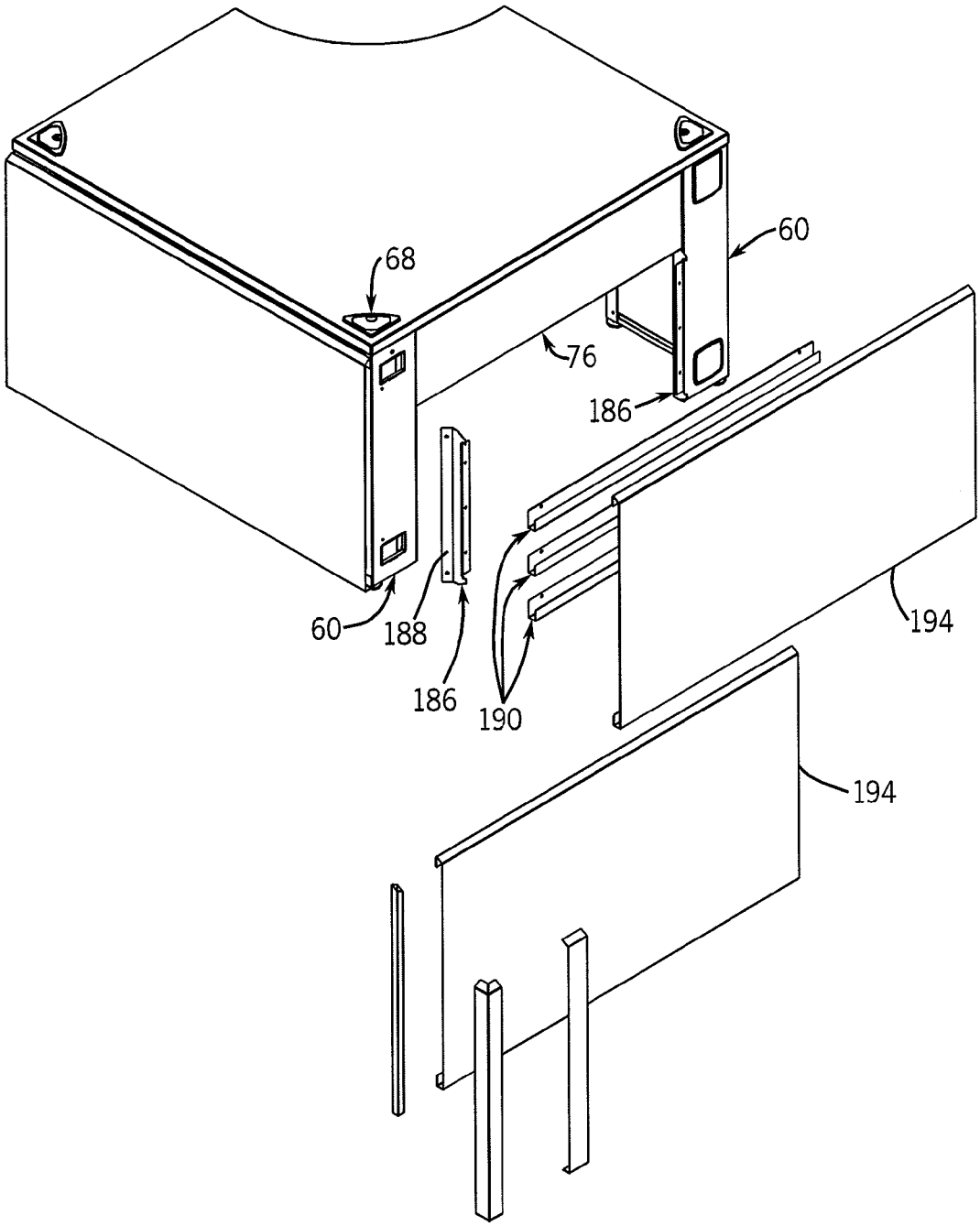
FIG. 6 is an exploded isometric view illustrating an alternative wiring support arrangement for the primary power distribution system incorporated in the desk system of FIG. 1.
Figure 7:
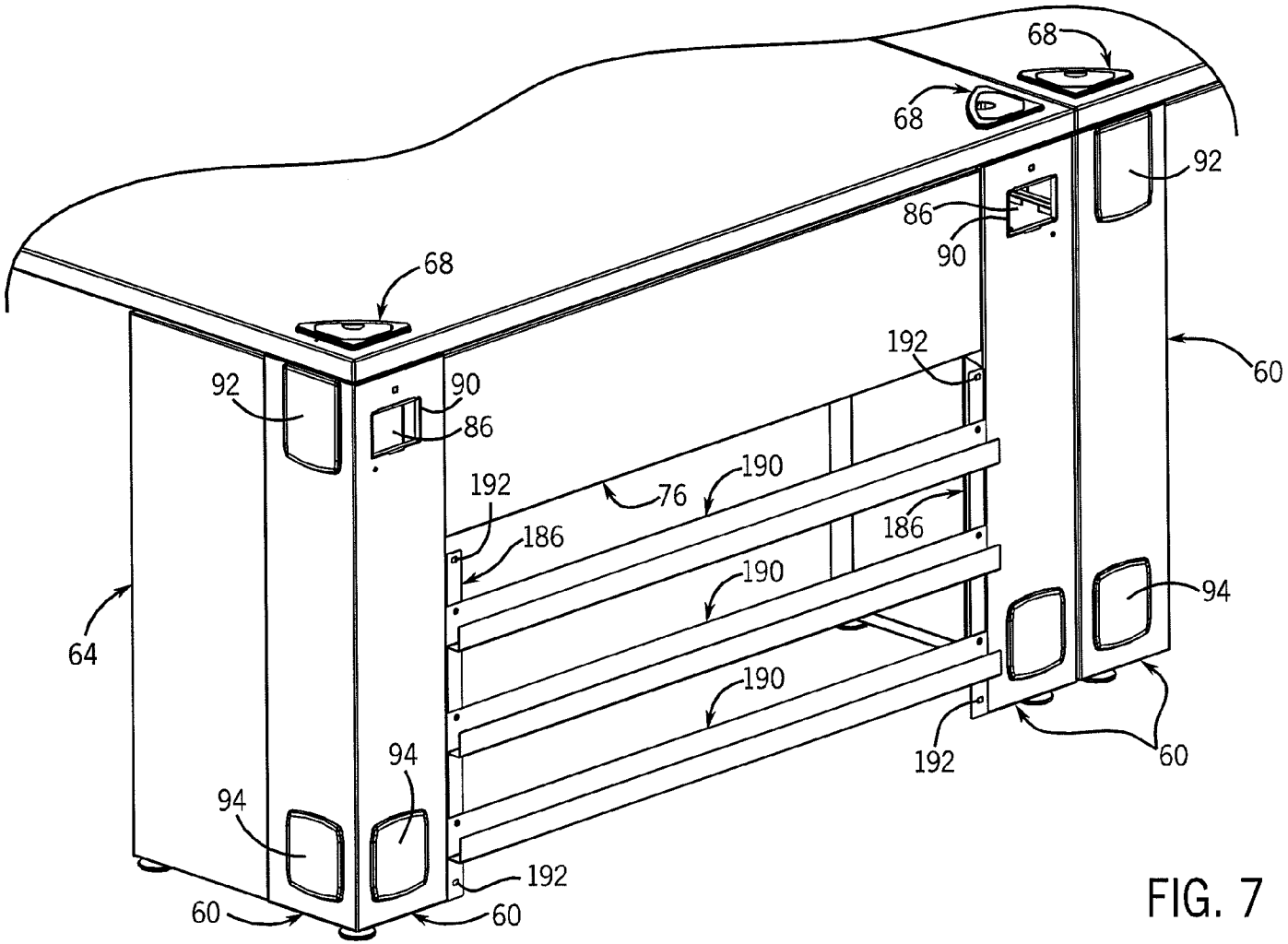
FIG. 7 is a partial isometric view showing the wiring support members incorporated in the alternative system of FIG. 6 mounted between the leg members of the desk system.
Figure 8:
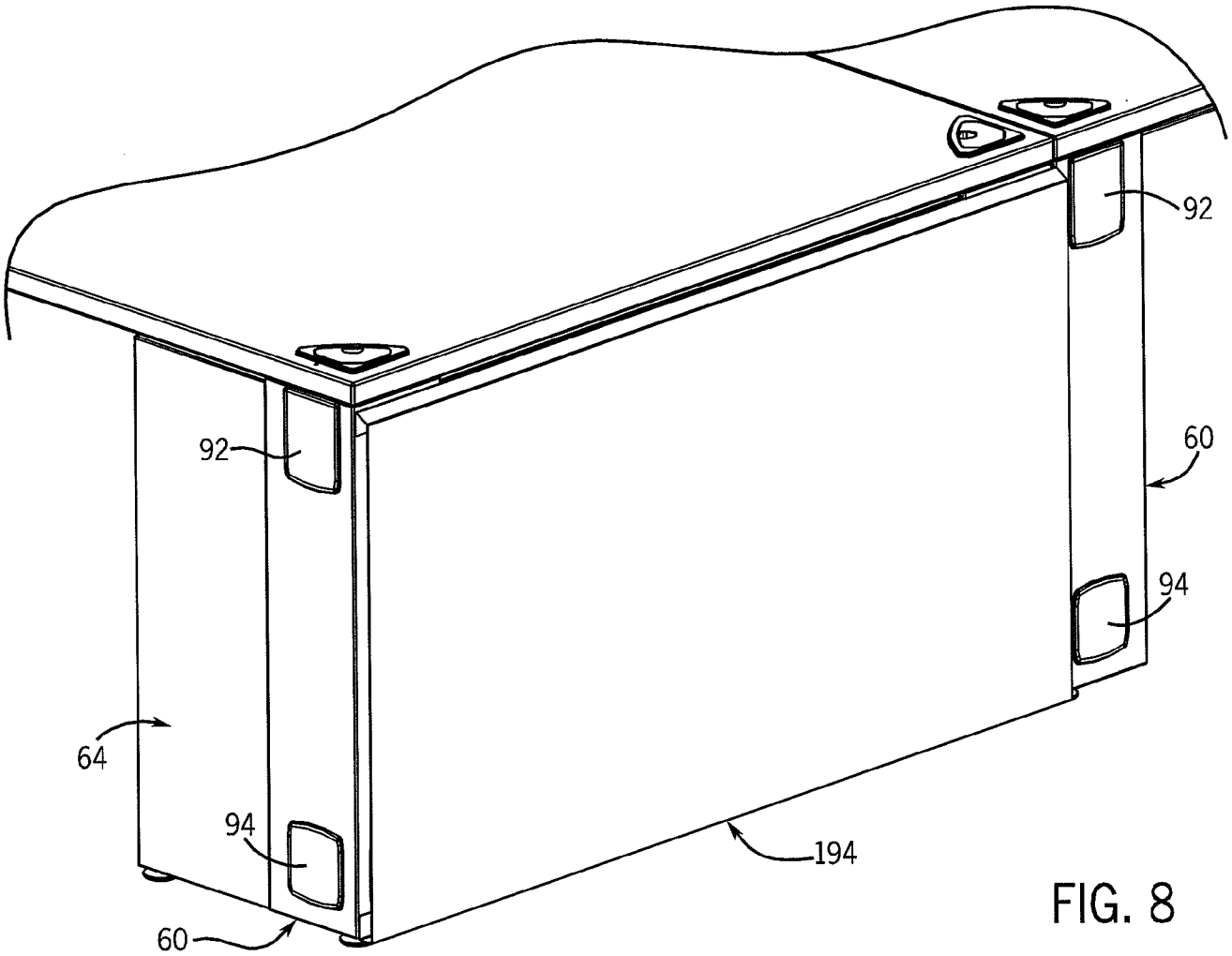
FIG. 8 is a view similar to FIG. 7, showing a cover positioned over the wiring support members.
Figure 9:
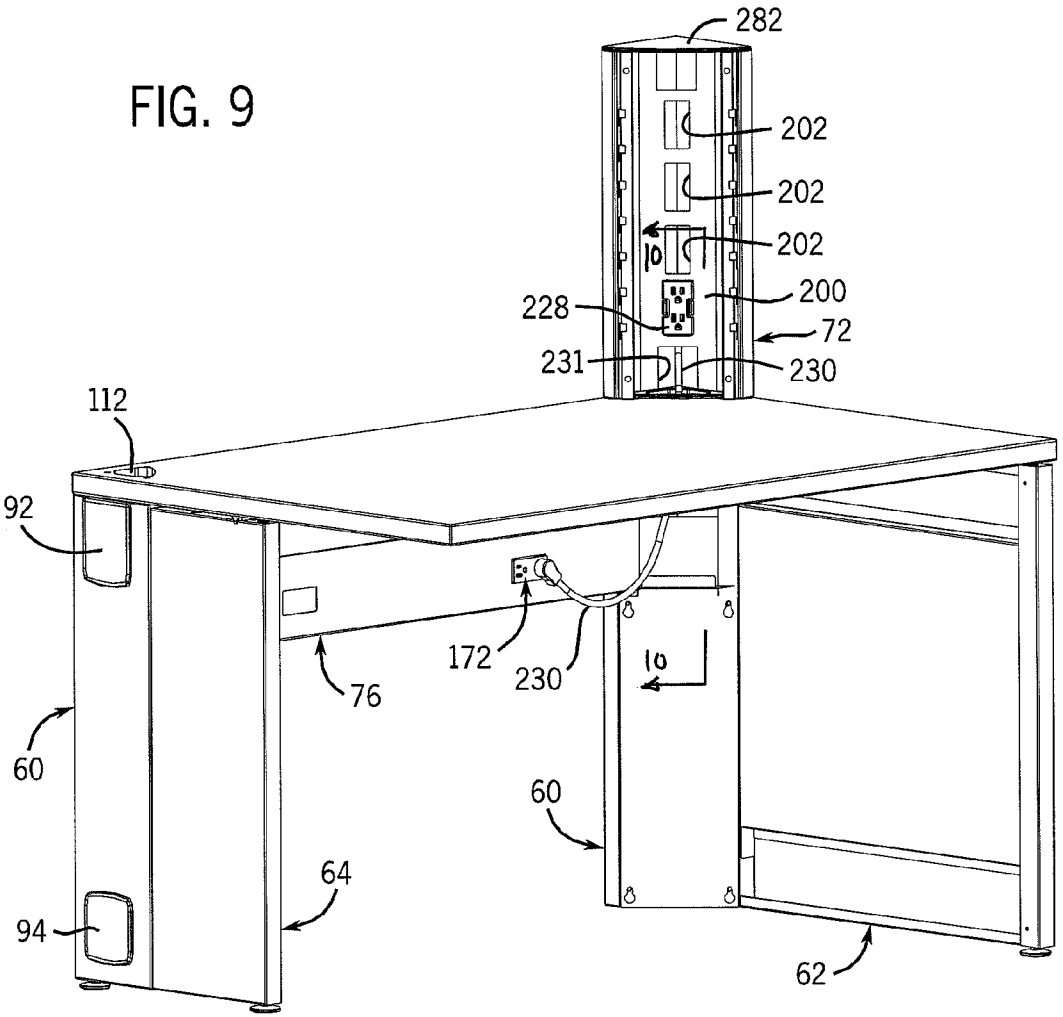
FIG. 9 is a partial isometric view showing a portion of a worksurface, a leg member and a stanchion incorporated in the desk system of FIG. 1 and the manner in which the stanchion power supply is interconnected with the primary power supply of the power distribution system.
Figure 10:
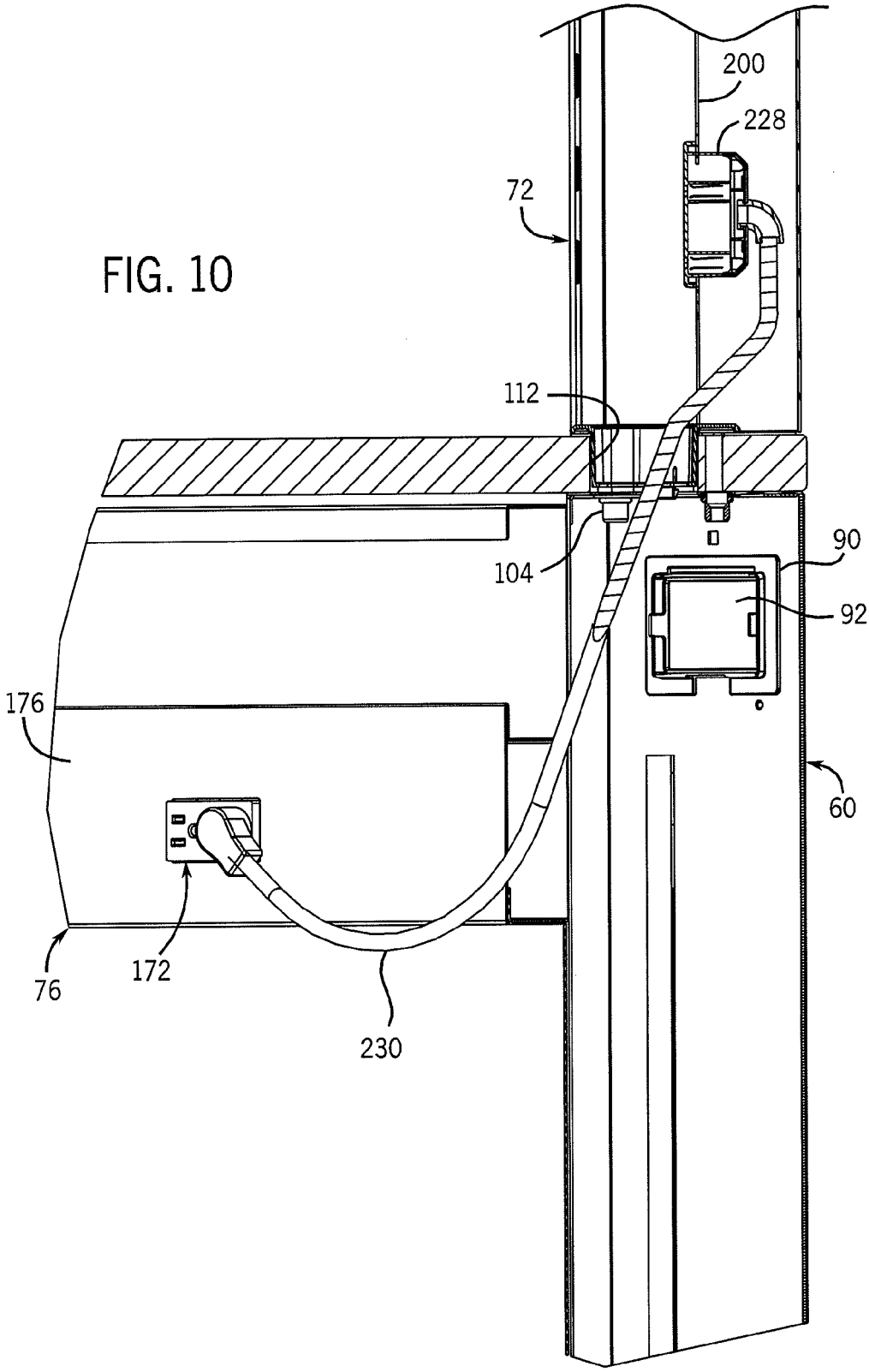
FIG. 10 is a partial section view taken along line 10-10 of FIG. 9.
Figure 11:
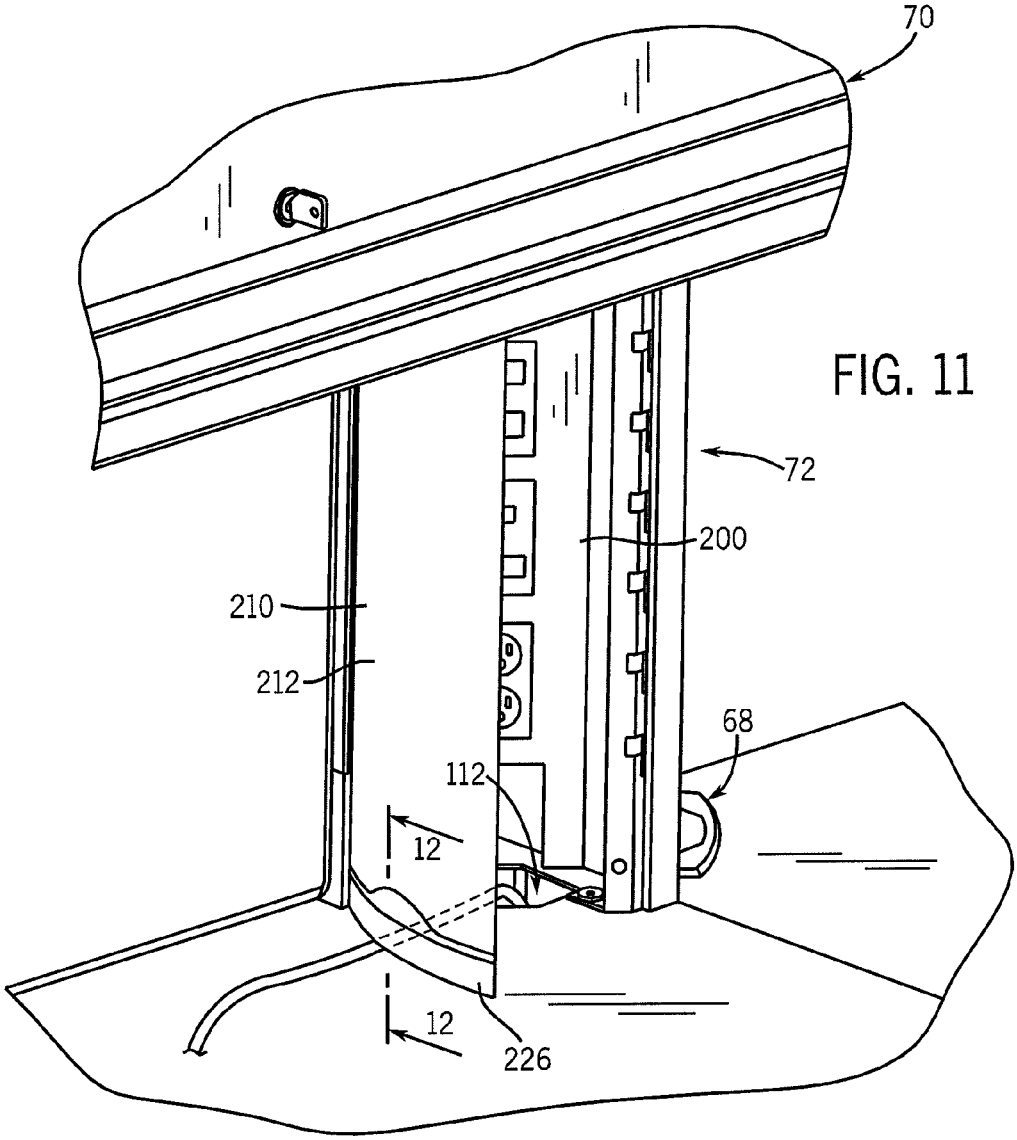
FIG. 11 is a partial isometric view showing the stanchion incorporated in the desk system of FIG. 1 and a cover for enclosing the components of the stanchion power supply.
Figure 12:
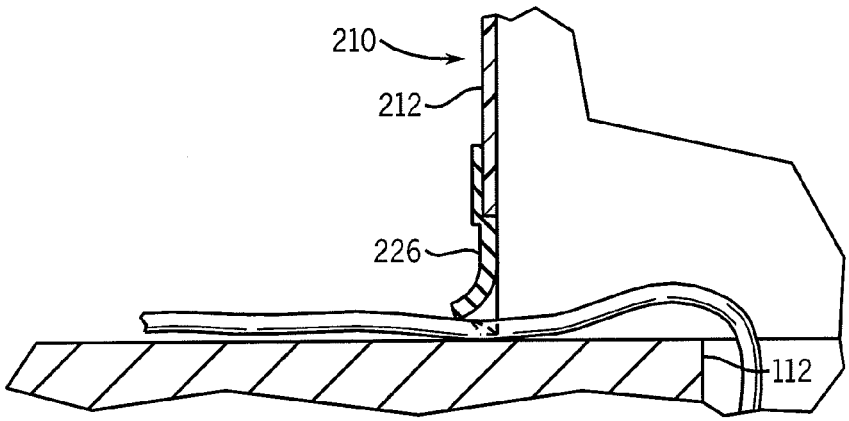
FIG. 12 is a partial section view taken along line 12-12 of FIG. 11.
Figure 13:
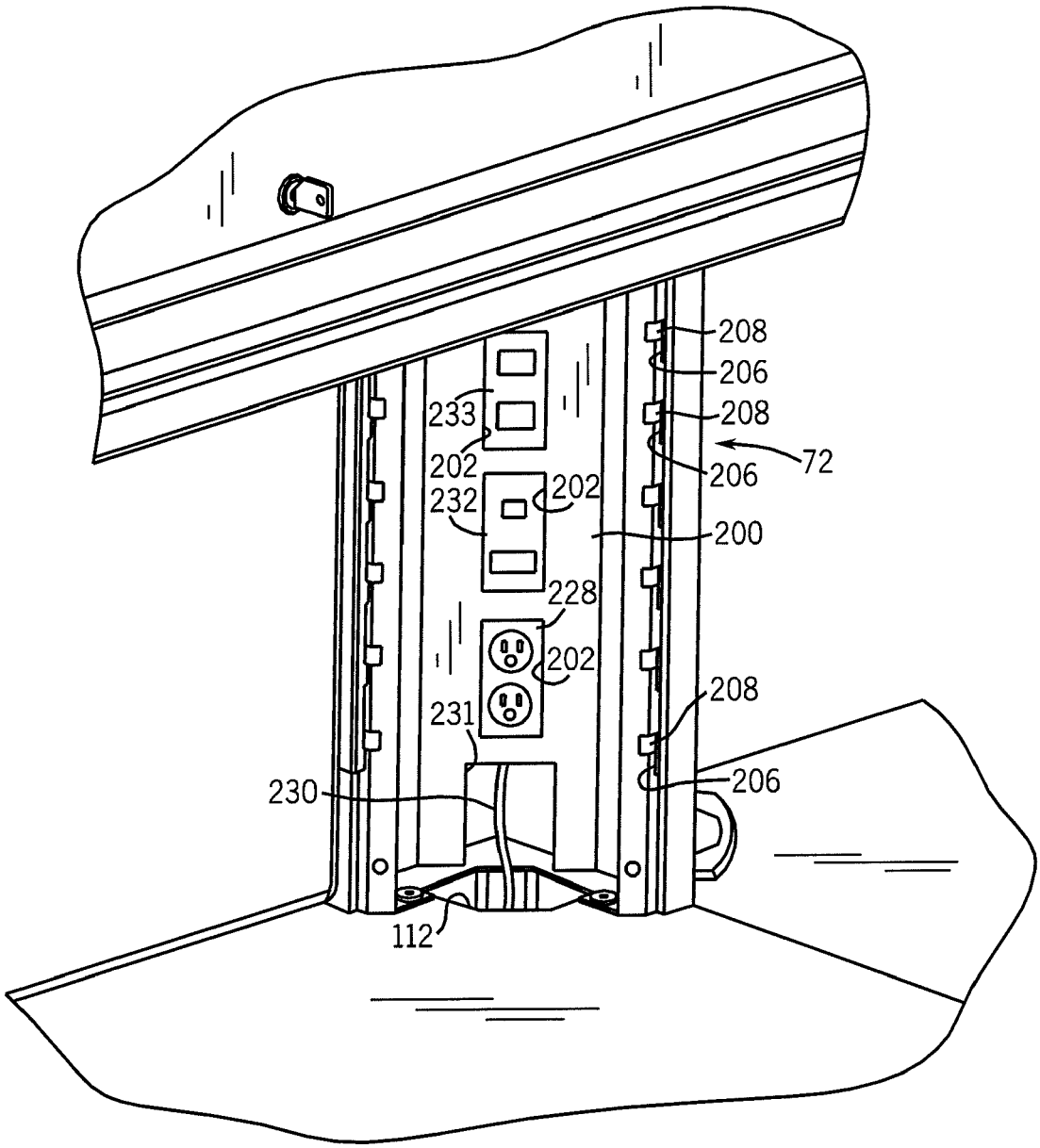
FIG. 13 is a view similar to FIG. 11, showing the cover removed.
Figure 14:
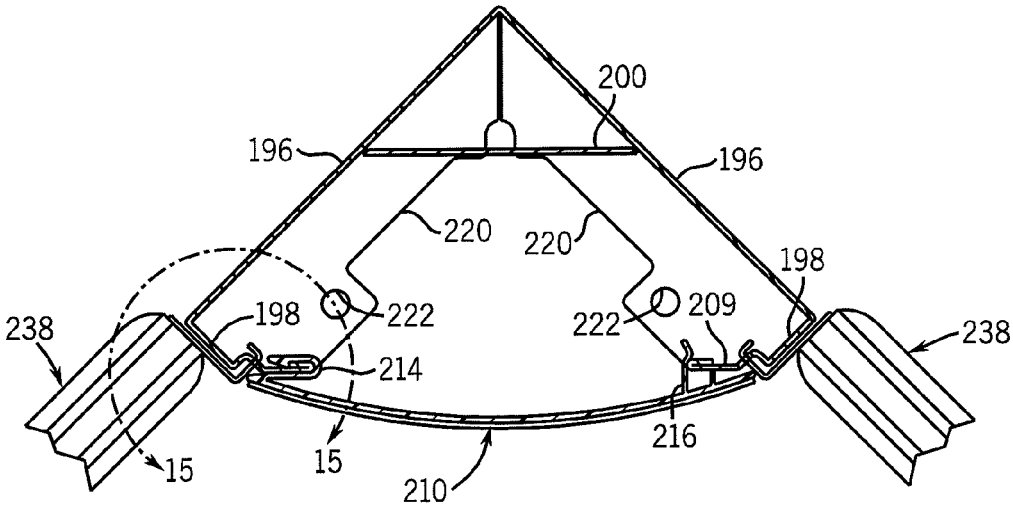
FIG. 14 is a section view through the stanchion illustrated in FIG. 11, showing the cover in a closed position.

It is also contemplated that a trough-type wiring support system may be associated with each desk section, e.g. in the event a rigid wireway power distribution system is prohibited by local electrical codes. An example of such a lay-in primary power distribution system is shown in FIGS. 6-8. In a power distribution system of this type, a series of troughs 190 extend between the legs 60 of each desk section, for providing lay-in wiring support in place of the rigid wireway power distribution described above. In addition to troughs 190, the trough-type system includes a pair of mounting brackets 186 secured one to each leg 60 via an angled mounting flange 188 secured to vertical flange 80 of one of legs 60. Troughs 190 extend between and are mounted to brackets 186, and each trough 190 is adapted to receive and support power, data or voice communication wiring between legs 60. Such wiring is communicated from leg to leg and to the upper area of the worksurface in the same manner as described previously.

A series of cover latch members are secured within openings 192 formed in brackets 186, and are configured to receive and engage catch members associated with a trough cover 194, so as to releasably mount trough cover 194 to and between legs 60.

Referring to FIGS. 11-15, stanchions 72 are adapted for engagement with one or more of the worksurfaces, such as 52. Stanchions 72 may be utilized to mount an overhead storage cabinet 70, or may stand alone to provide power and/or data connections above the worksurface. In the illustrated embodiment, each stanchion 72 is constructed similarly to each leg 60, including perpendicular outer walls 196 having inwardly turned outer ends which define a pair of spaced apart flanges 198. A mounting or reinforcement plate 200 extends between and is mounted to the inner surfaces of walls 196 such as by welding, and includes a series of openings 202.

Each stanchion 72 includes a pair of bracket mounting walls 204, each of which extends from one of flanges 198. A series of vertically spaced bracket mounting slots 206 are formed in each mounting wall 204. Each slot 206 extends downwardly from an enlarged upper entrance area 208. A cover mounting flange 209 extends from the end of each bracket mounting wall 204, and includes a folded outer end 211.

A cover 210 is adapted to engage the open front of each stanchion 72. Cover 210 may be in the form of a coextruded member, having a rigid outer wall 212, a rigid hook-type mounting section 214, and a latch member 216. A resilient hinge area 218 is located between mounting section 214 and outer wall 212, for enabling outer wall 212 to be pivoted relative to mounting section 214. With this arrangement, mounting section 214 is engageable with cover mounting flange 209 of one of flanges 198 via engagement of the hook associated with cover mounting section 214 with the folded outer end 211 of cover mounting flange 209, and latch member 216 is engageable with the opposite cover mounting flange 209. Cover 210 can thus be pivoted about hinge area 218 by disengaging latch member 216 from the inner edge of its associated cover mounting flange 209, and applying an outward force on cover 210 for providing pivoting movement about hinge area 218. Cover 210 can be moved to an engaged position by applying an inward force to cover 210, for moving latch member 216 into engagement with its associated cover mounting flange 209 and to thereby releasably maintain cover 210 in a closed position for selectively preventing access to the interior of stanchion 72. The ends of cover 210 are located and oriented such that slots 206 in bracket mounting wall 204 are exposed when cover 210 is in either its open or closed position.

Outer wall 196 of each stanchion 72 includes a lower worksurface mounting flange 220, which is adapted for placement in the corner of the worksurface such that openings 222 formed in mounting flange 220 are in alignment with openings in the worksurface, which in turn are in alignment with rivet nuts 104 associated with leg 60. In this manner, screws or other satisfactory fasteners extend through the aligned openings into engagement with rivet nuts 104, for securing stanchion 72 to the worksurface such as 52, and in turn securing worksurface 52 to the underlying leg 60. The worksurface opening, shown at 112, is in alignment with the open interior of stanchion 72. In this manner, wiring or cables from below the worksurface can be fed upwardly into the interior of stanchion 72, and vice versa. Cover 210 includes a resilient lower lip 226, which provides a resilient seal about cables or wires extending from the interior of stanchion 72 outwardly onto the upper area of the worksurface.

As shown in FIGS. 9-13, one or more power outlet blocks 228 are adapted for engagement within openings 202 of mounting plate 200. Power outlet block 228 includes outwardly facing receptacle structure adapted to receive a plug associated with a cord from an item of equipment supported by the worksurface, to provide electrical power to the item of equipment. Power outlet block 228 is preferably releasably engaged within opening 202, to enable power outlet block 228 to be removed, replaced or relocated as desired. A cord 230 extends from power outlet block 228 and includes a plug 232. Cord 230 is adapted to extend through the open interior of stanchion 72 behind mounting plate 200, and through a recess 231 that extends upwardly from the bottom edge of mounting plate 200, into and through the worksurface opening 112 into engagement with one of the receptacles associated with outlet block 172 located below the worksurface. In this manner, power outlet blocks 228 provide electrical power above the worksurface, which is convenient for the user to access simply by opening cover 210. In addition to power outlet block 228, mounting plate 200 is also configured to receive other components such as a communication jack block 232, a fiber optic cable connection block 233, etc. Each of blocks 232, 233 includes a flexible cord or cable (not shown)that extends from below the worksurface through worksurface opening 112 and recess 231 in mounting plate 200 for connection to the respective block 232, 233. Mounting plate 200 includes a series of openings 202, each of which is configured to receive and engage one of blocks 232, 233. Openings 202 may all have the same configuration such that blocks 228, 2332 and 233 may be interchanged with each other, or each opening and its associated mounting block may have a unique configuration. In the event one of the openings 202 is not used, a filler plate is preferably engaged within the unused opening As an alternative to hinged cover 210, a snap-type cover may be provided for selectively closing the open interior of each stanchion 72. The snap-type cover includes resilient mounting snaps or fingers similar to 216 on both sides, which are configured to be releasably engaged with the edges of cover mounting wall 209. Any other satisfactory releasable mounting arrangement may be employed.

Figure 15:
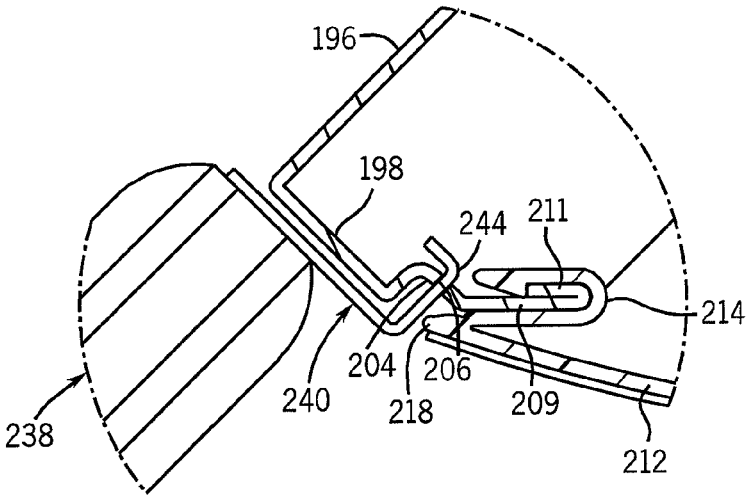
FIG. 15 is an enlarged partial section view with reference to lines 15-15 of FIG. 14.
Figure 16:
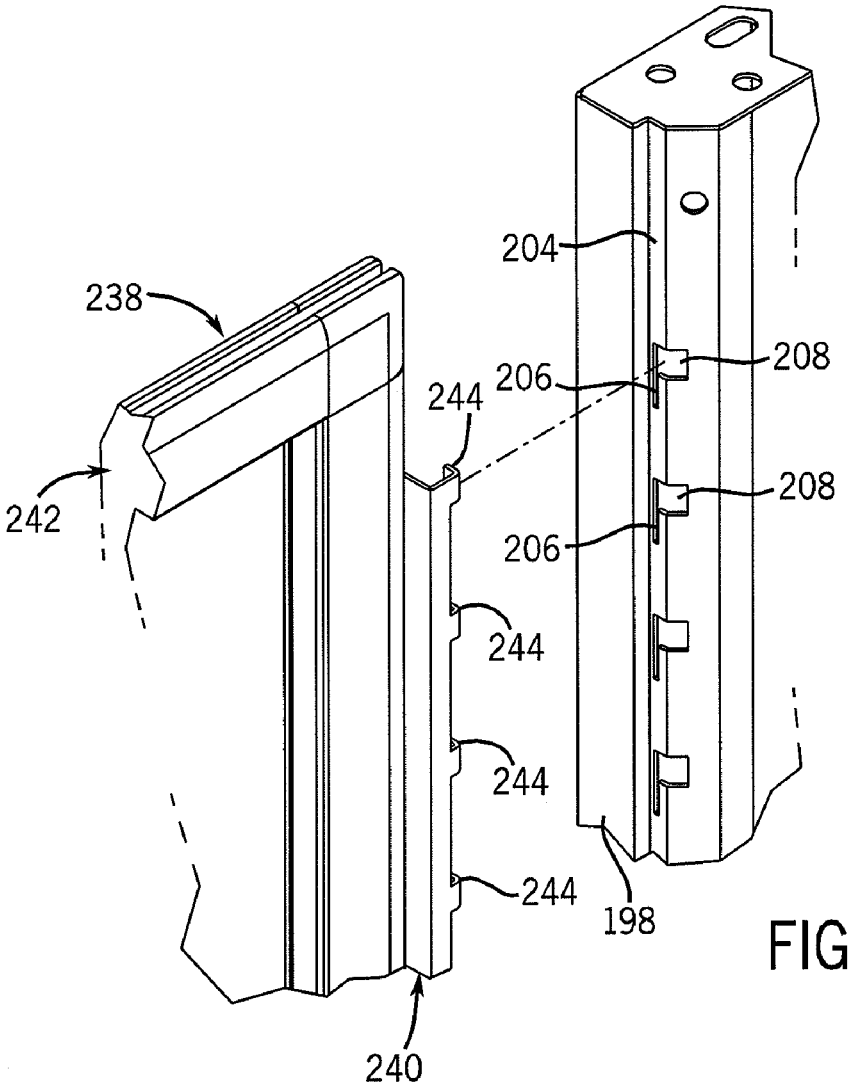
FIG. 16 is a partial isometric view showing engagement of a privacy screen with the stanchion incorporated into the desk system of FIG. 1.

Referring to FIGS. 15 and 16, s privacy screen assembly 238 may be engaged between adjacent stanchions 72 associated with each desk section above the worksurface of the desk section. Privacy screen assembly 238 includes a pair of mounting brackets 240 and a screen member 242 mounted between brackets 240. Brackets 240 have teeth 244, which are adapted to be received within enlarged entrance areas 208 and slots 206 in bracket mounting walls 204 of spaced apart stanchions 172, and moved downwardly into slots 206 for mounting privacy screen assembly 238 to and between stanchions 72.

FIGS. 17-22 illustrate the components of differently configured desk sections that may be incorporated into a desk system constructed according to the invention. It is understood that the desk sections illustrated in FIGS. 17-22 are simply examples of the types of desk sections that may be utilized in the desk system of the present invention, and that numerous other sizes, shape, components and configurations are possible.

Figure 17:
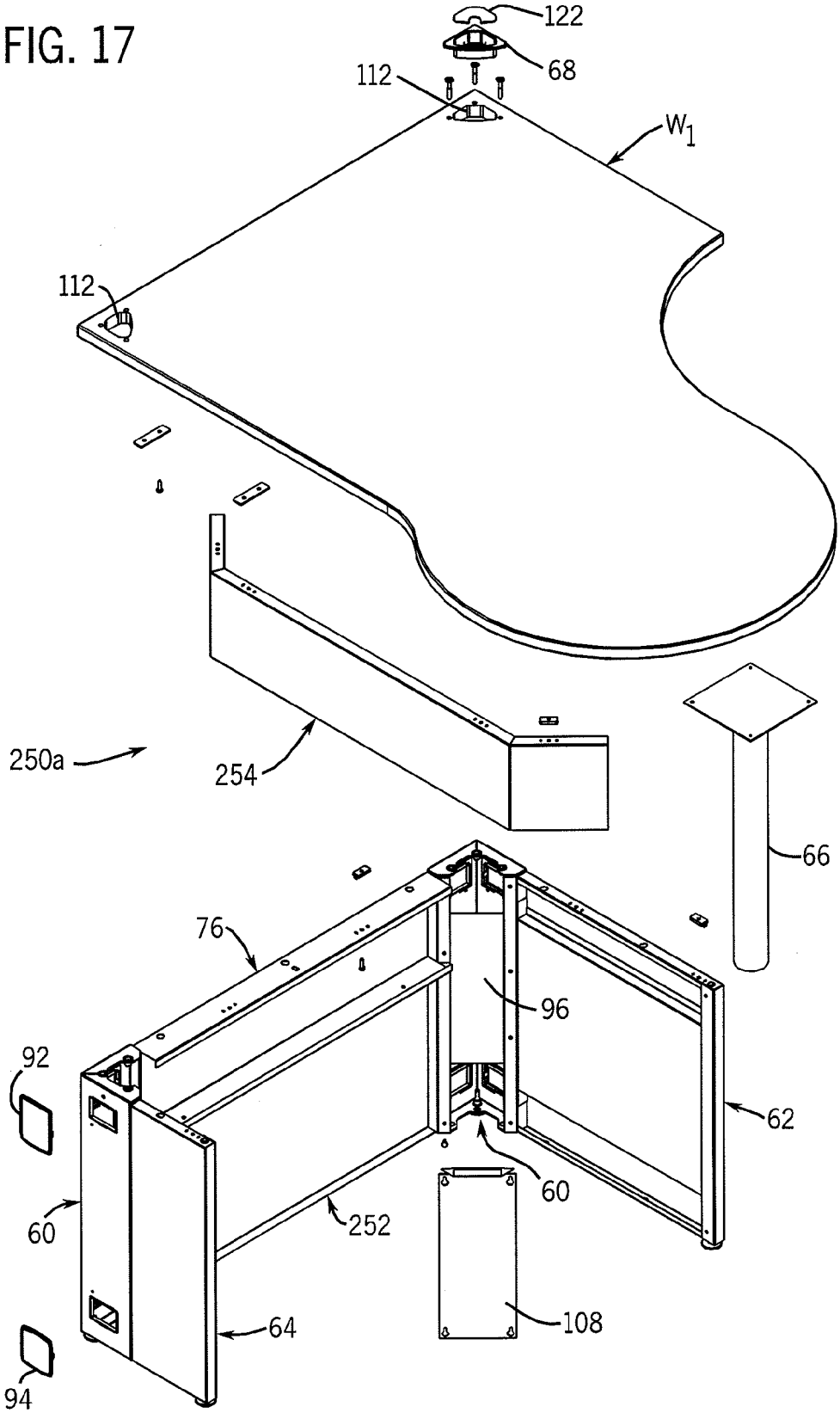
FIGS. 17-20 are exploded isometric views showing components for constructing differently configured desk sections adapted to be incorporated in a desk system such as that shown in FIG. 1.

In a desk section 250*a* as shown in FIG. 17, worksurface W1 includes an extension that is supported by a leg 66. A full width end panel 62 is mounted to one of legs 60, and a partial width end panel 64 is mounted to the other leg 60. A modesty panel, shown at 252, is mounted below beam 76 between legs 60. A partial height side panel 254 is mounted to the underside of worksurface W1.

Figure 18:
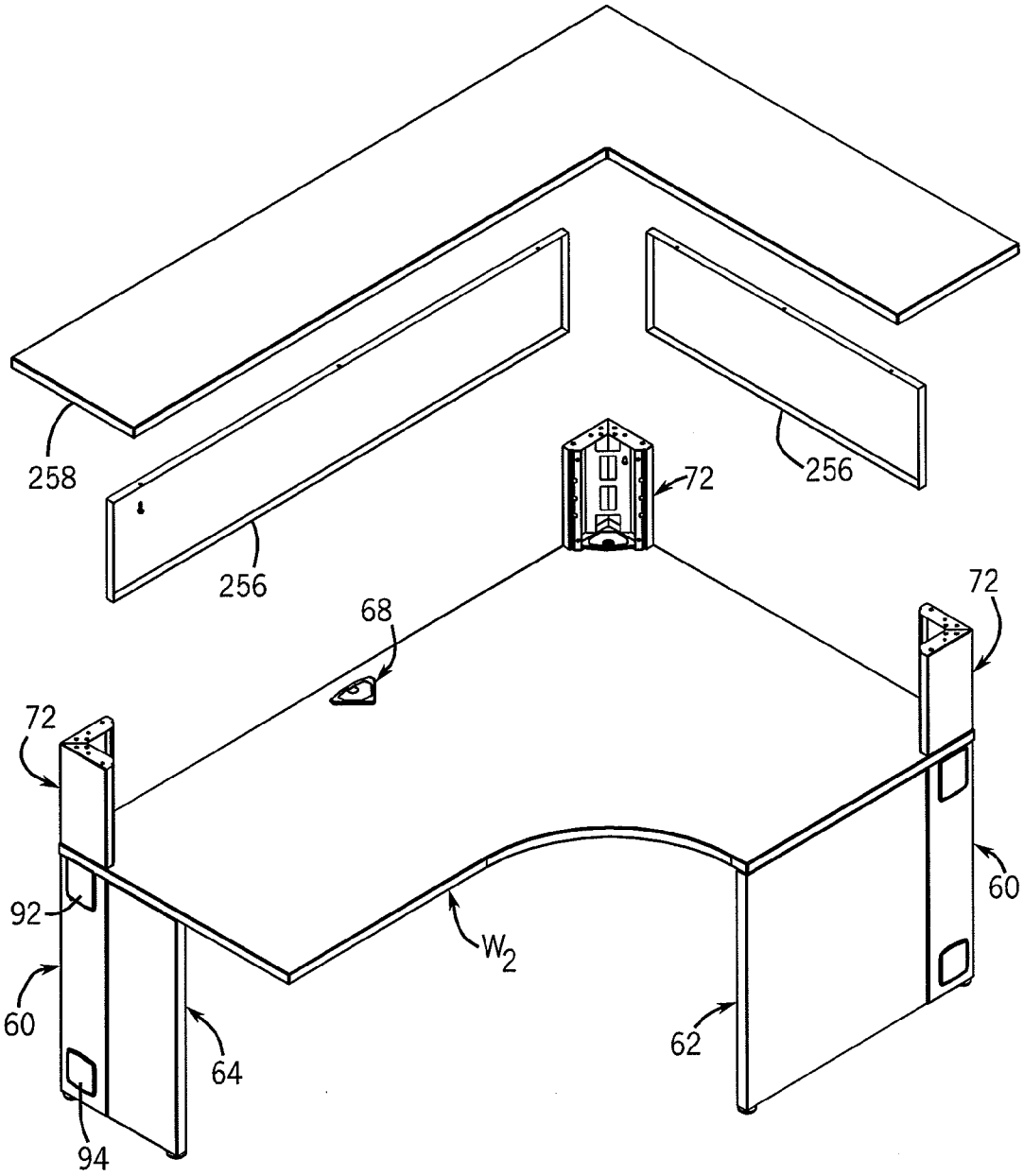

In a desk section 250*b* as shown in FIG. 18, a set of three legs 60 are used to engage the outer corners of a worksurface W2, and a stanchion 72 is located at each corner of worksurface W2. A worksurface opening and its associated access member 68 is located between two of the stanchions 72. Screens 256 are mounted between the stanchions 72 above worksurface W2, and an upper support surface 258 is mounted to the upper ends of stanchions 72 above the upper edges of screens 256.

Figure 19:
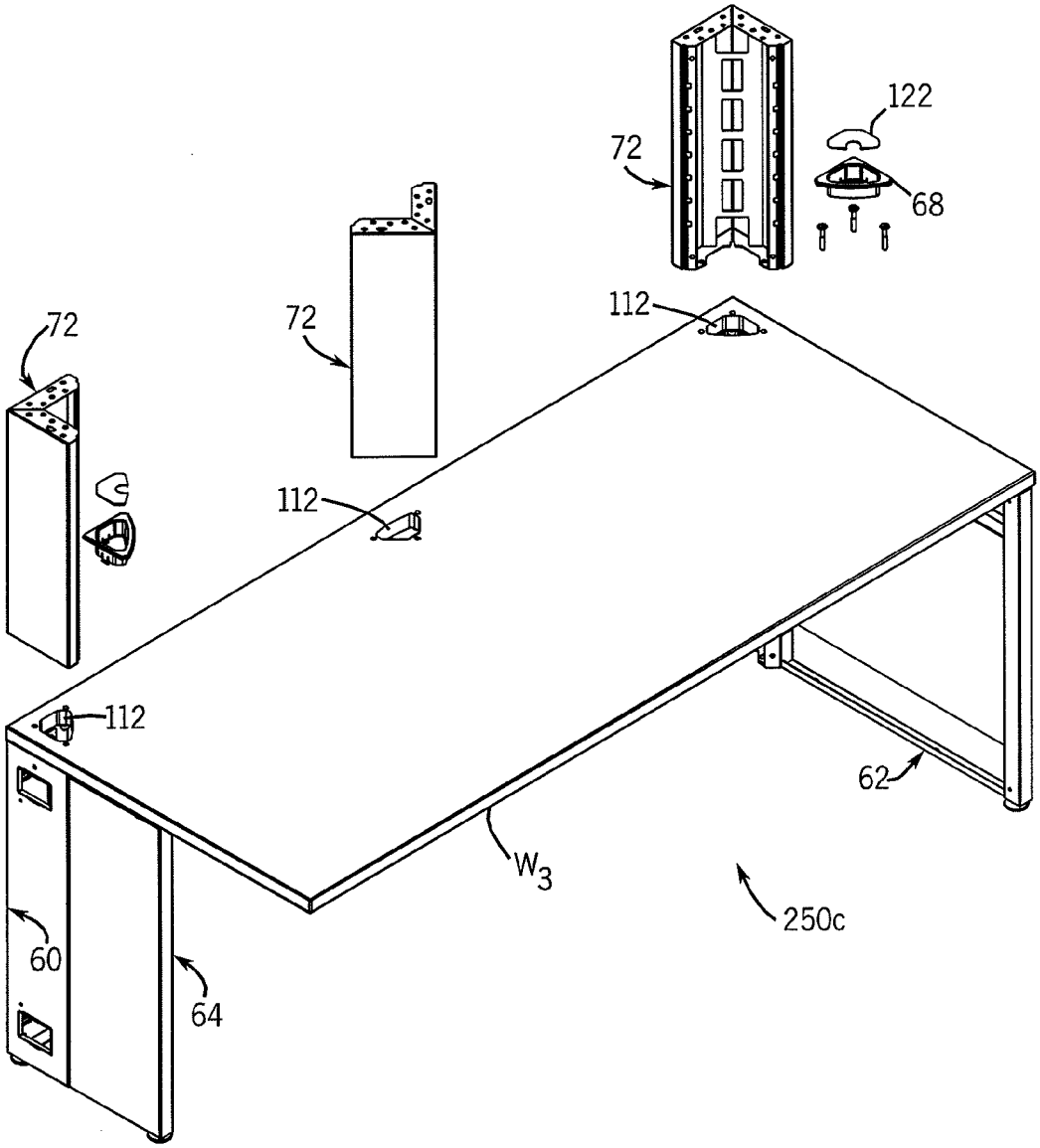

FIG. 19 shows an elongated rectangular desk section 250*c* having a worksurface W3, in which a central stanchion 72 is located between the two end or corner stanchions 72 over a central worksurface opening 112. The central stanchion 72 faces outwardly, to provide power and communication capability to an adjacent non-powered worksurface.

Figure 20:
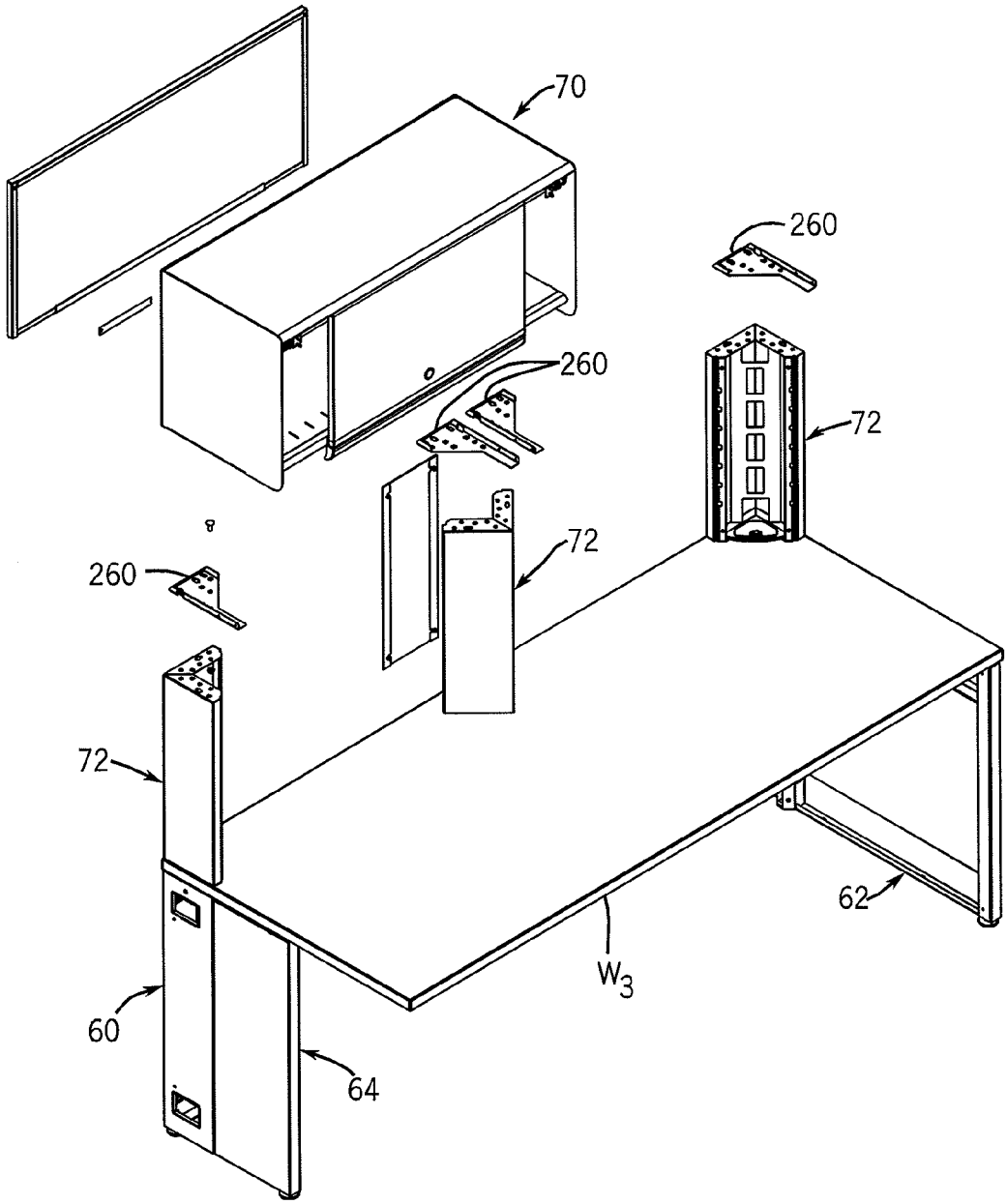

FIG. 20 illustrates desk section 250*c* having an overhead storage unit 70 mounted between a pair of adjacent stanchions 72. Overhead mounting brackets 260 are mounted to the upper ends of stanchions 72, and are configured to support overhead storage unit 70 above stanchions 72. The central stanchion 72 may be provided without power and/or communication components, and may be located simply to provide support for overhead storage units such as 70. Wiring may extend through the open interior of central stanchion 72 for supplying power to a task light or other electrical component associated with overhead storage unit 72.

Figure 21:
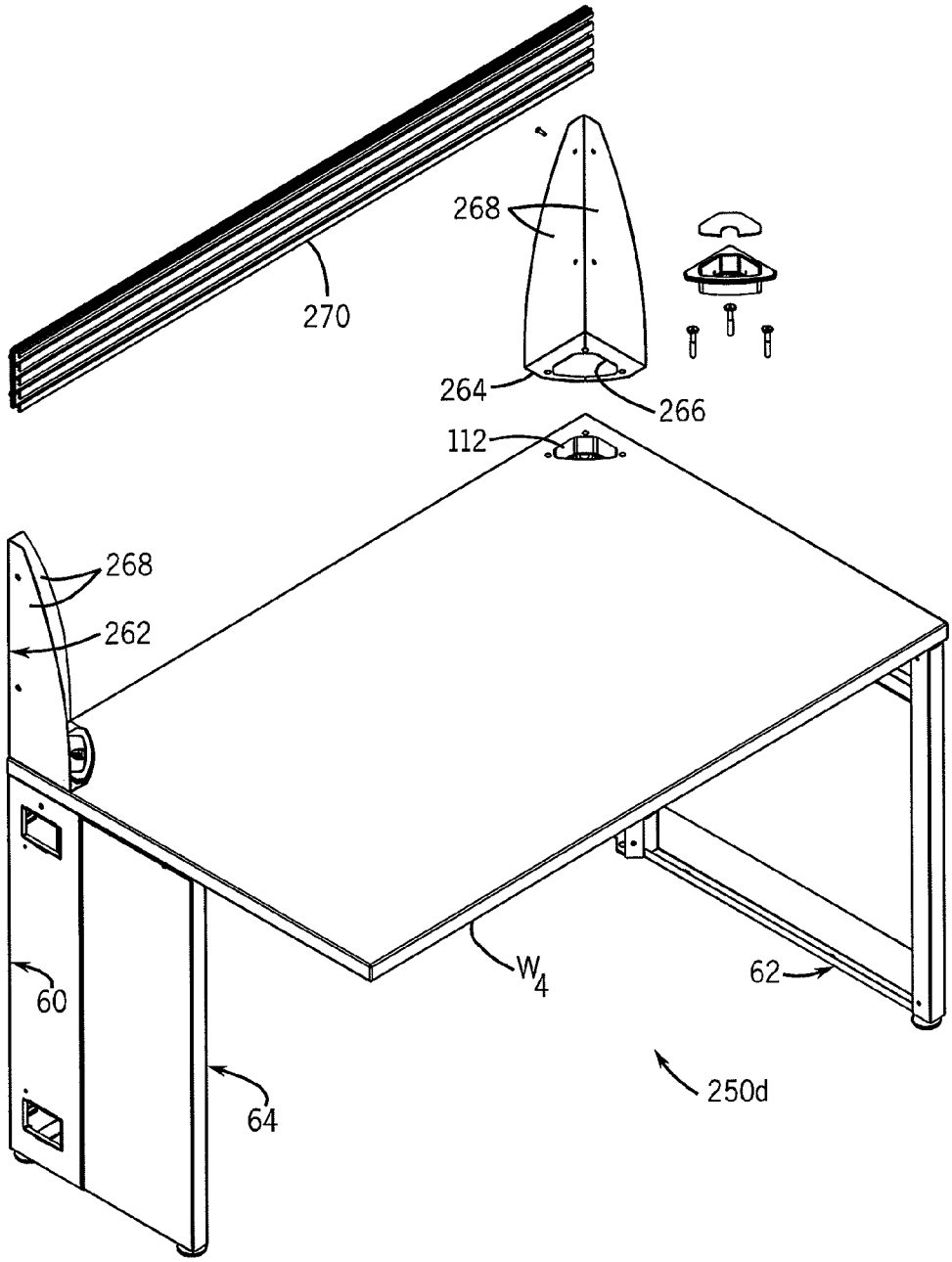
FIG. 21 is an exploded isometric view illustrating components for constructing a desk section having a differently configured support system above the worksurface, for incorporating into the desk system of FIG. 1.

FIG. 21 shows a desk section 250*d* having a worksurface W4, and incorporating the primary power and communication distribution system below worksurface W4. In desk section 250*d*, stanchions 72 are eliminated and are replaced with support members 262 located over worksurface openings 112. Each support member 262 includes a lower mounting plate 264 having an opening 266, and is adapted to be mounted to the worksurface 250*d* such that opening 266 is located over worksurface opening 112. Access member 68 is secured to mounting plate 264 over opening 266, for enabling cables and cords to pass below worksurface 250*d* for connection with the primary power and communication distribution system below worksurface 250*d*. A pair of angled walls 268 extend upwardly from mounting plate 264, and are adapted to support a worksurface accessory such as a tool rail 270. It is also understood that a tool rail such as 270, or any other type of worksurface accessory, may be mounted to an between stanchions 72 in the previously described embodiments of the desk system of the present invention.

Figure 22:
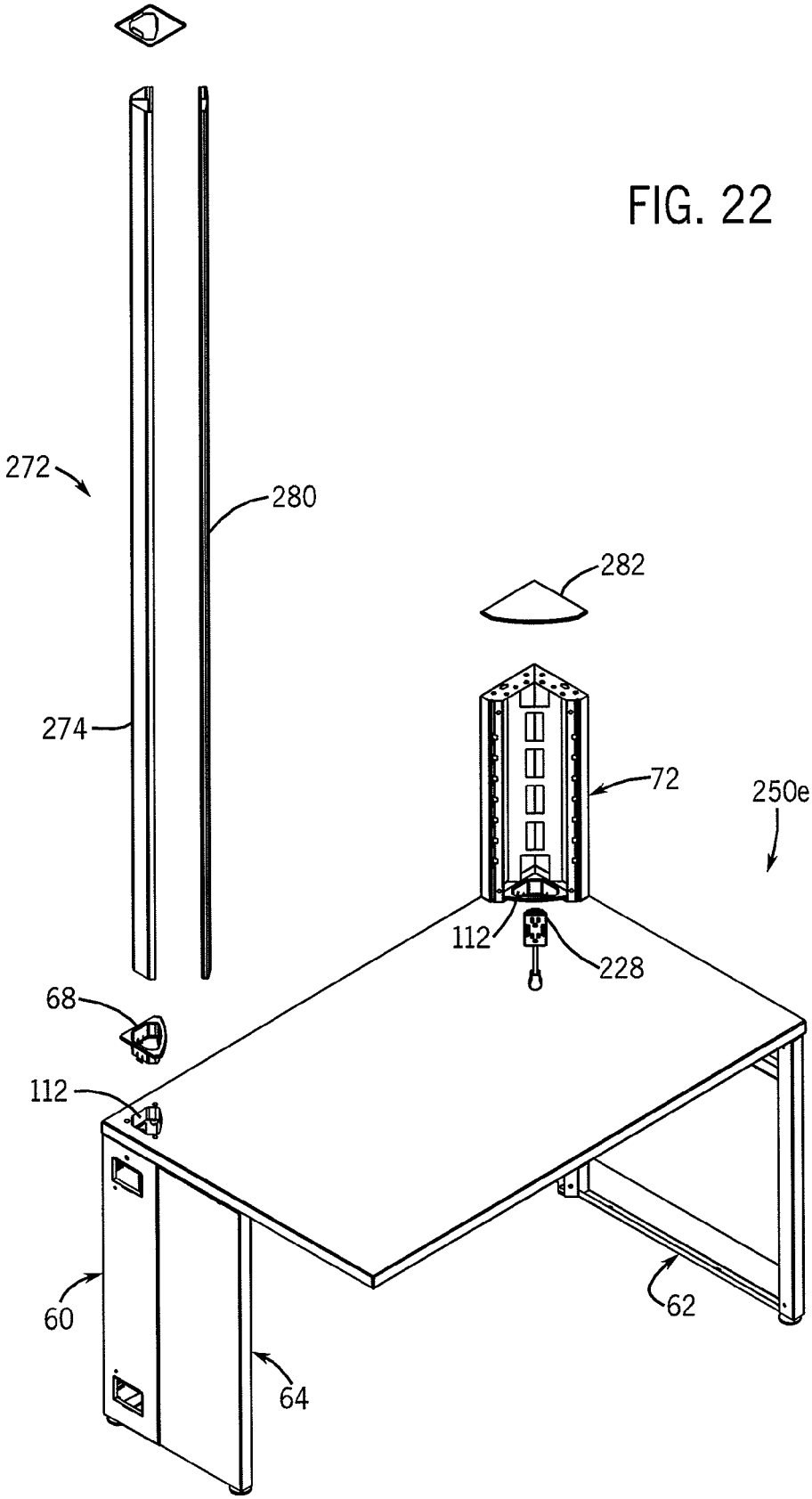
FIG. 22 is an exploded isometric view illustrating a desk section for incorporating into a desk system such as shown in FIG. 1, in which power is supplied from the ceiling of a space in which the desk system is located.
Figure 23:
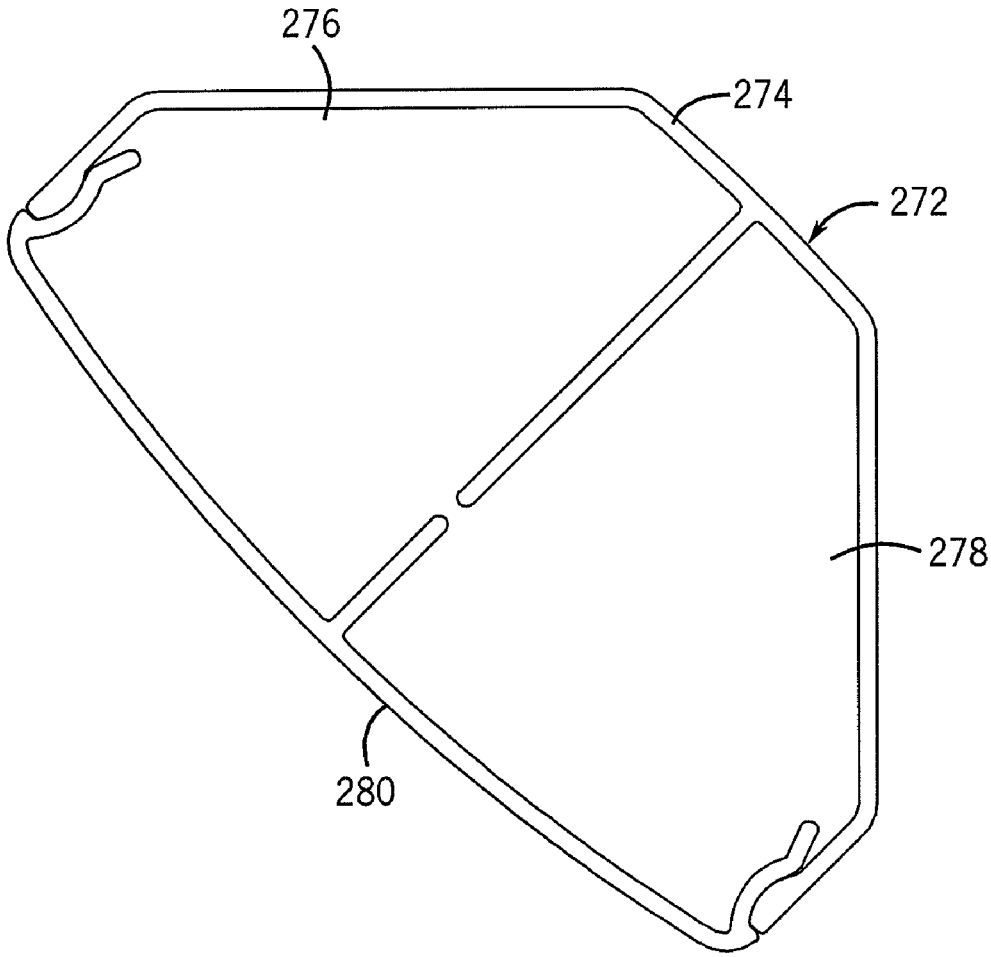
FIG. 23 is a section view showing the ceiling power supply arrangement incorporated in the desk section of FIG. 22.

FIG. 22 shows a desk section 250*e* including a stanchion 72 at one end and a top feed power supply housing 272 at the other end. To provide input power and/or communication wiring to desk system 50 from above, such as by an electrical or communication system located in a ceiling, top feed power supply housing 250 extends between the ceiling and the access member 68 mounted over one of the worksurface openings 112. As shown in FIG. 23, top feed power supply housing 272 includes a base 274 defining a pair of isolated passages 276, 278, and a removable cover 280 which is selectively engageable with base 274 to provide access to the interior passages 276, 278 of base 274. Base 274 and cover 280 of top feed power supply housing 274 are configured to fit within the opening of access member 68, such that access member 68 provides a trim about the portion of housing 272 that extends into worksurface opening 112.

In an application in which a stanchion 72 is used alone without an overhead storage unit mounted to the stanchion 72, the stanchion 72 functions as a power/communication module to provide power and communication connections above the worksurface. As shown in FIG. 22, a cap 282 is adapted for engagement with the open upper end of stanchion 72 so as to enclose the interior of stanchion 72 and to provide a finished external appearance. Cap 282 includes snap-type retainers adapted for engagement within the openings associated with the upper flange of stanchion 72.

It can thus be appreciated that desk system 50 provides a flexible and configurable desk arrangement with power and/or communication capability, which can be altered and configured according to user requirements and specifications. The power and communication components incorporated in desk system 50 can be changed subsequent to installation to enable the user to adapt the desk system for different uses and equipment as desired.

Various alternatives and modifications are contemplated as being within the scope of the following claims particularly pointing out and distinctly claiming the subject matter regarded as the invention.

I claim:

1. A desk system, comprising:

a pair of spaced apart leg members, wherein at least one of the leg members includes an open interior area;

a worksurface supported by the pair of leg members;

a power stanchion located above at least one of the leg members, wherein the power stanchion includes at least a pair of outer walls oriented at an angle to each other, and an internal wall that extends between and is fixed to the outer walls and that cooperates with the outer walls to define a power stanchion passage located inwardly of the internal wall and an outer area located outwardly of the internal wall, wherein the internal wall includes a receptacle mounting area located above the worksurface that defines one or more openings;

wherein the worksurface includes an opening arranged to establish communication between the receptacle mounting area and the open interior area of the leg member;

a power supply arrangement including a primary power supply located below the worksurface and a stanchion power supply that is separate from the walls of the power stanchion, wherein the stanchion power supply extends from the primary power supply through the opening in the worksurface and includes one or more stanchion power supply members defining one or more power supply receptacles, wherein each stanchion power supply member is engaged within one of the openings defined by the receptacle mounting area of the internal wall of the power stanchion at the receptacle mounting area defined by the internal wall; and a cover movably engaged with the power stanchion, wherein the cover is movable between an open position and a closed position while engaged with the power stanchion, wherein the cover and the outer walls of the power stanchion are configured such that the cover in the open position provides access to the outer area of the power stanchion and to the one or more power supply receptacles, and wherein the cover in the closed position prevents access to the outer area of the power stanchion and to the one or more power supply receptacles.

2. The desk system of claim 1, wherein a power stanchion is located above each of the leg members and wherein the worksurface includes a pair of openings, each of which is arranged to establish communication between the open interior area of one of the leg members and the receptacle mounting area of the power stanchion located above the leg member, and further comprising an overhead storage member supported between the power stanchions.

3. The desk system of claim 1, wherein the internal wall of the power stanchion is defined by an internal plate member that extends between and is fixed to the pair of outer walls of the power stanchion.

4. The desk system of claim 1, wherein the cover includes a lower edge located adjacent an upwardly facing surface defined by the worksurface, and further comprising a resilient seal member associated with the lower edge of the cover, wherein the resilient seal member is constructed and arranged to accommodate one or more power cords extending from one or more items supported by the worksurface and engaged with the power supply receptacles.

5. The desk system of claim 1, wherein the cover is pivotably mounted to the stanchion for movement between the open and closed positions.

6. The desk system of claim 1, wherein each leg member includes a pair of generally perpendicular outer walls.

7. The desk system of claim 6, wherein each leg member further includes a cover member that extends between and is interconnected with the outer walls, wherein the outer walls and the cover member cooperate to define the open interior area of the leg member.

8. The desk system of claim 7, wherein the cover member is removably mounted to and between the outer walls to provide selective access to the internal area of the leg member.

9. The desk system of claim 6, wherein the desk system includes a first pair of leg members and a first worksurface that cooperate to define a first desk section, and a second pair of leg members and a second worksurface that cooperate to define a second desk section, wherein each outer wall of each leg member includes an opening, and wherein the openings in the outer walls of one of the leg members in the first pair of leg members and in one of the leg members in the second pair of leg members are positioned to be in alignment with each other when the first and second desk sections are positioned adjacent each other, wherein the primary power supply of the power supply arrangement is configured to extend through the aligned openings to supply power to the first and second desk sections.

10. The desk system of claim 9, wherein the outer wall of each leg member defines an upper end and a lower end, and wherein the outer wall of each leg member includes an upper opening located toward the upper end and a lower opening located toward the lower end.

11. The desk system of claim 9, wherein an opening in one of the outer walls of one of the leg members of each of the first and second pairs of leg members are positioned in alignment with each other for supplying power between the first and second desk sections, and wherein the opening in the other of the outer walls of the leg members are exposed, and further comprising a leg opening cover engaged within the exposed openings.

12. The desk system of claim 1, wherein the primary power supply includes a power supply outlet located below the worksurface, and wherein the stanchion power supply comprises a flexible cord that extends from the stanchion power supply member into engagement with the power supply outlet of the primary power supply.

* * * * *